US006927331B2

(12) United States Patent
Haase

(10) Patent No.: US 6,927,331 B2
(45) Date of Patent: Aug. 9, 2005

(54) METHOD FOR THE PROGRAM-CONTROLLED VISUALLY PERCEIVABLE REPRESENTATION OF A MUSIC COMPOSITION

(76) Inventor: Rainer Haase, Loschwitzer Weg 20, D-13593 Berlin (DE)

( * ) Notice: Subject to any disclaimer, the term of this patent is extended or adjusted under 35 U.S.C. 154(b) by 31 days.

(21) Appl. No.: 10/714,740

(22) Filed: Nov. 17, 2003

(65) Prior Publication Data

US 2004/0148575 A1 Jul. 29, 2004

(51) Int. Cl.[7] ..... A63J 17/00
(52) U.S. Cl. ..... 84/464 R; 84/461
(58) Field of Search ..... 84/464 R, 461–464 A, 84/600–604, 626, 482, 483.2

(56) References Cited

U.S. PATENT DOCUMENTS 5,247,864 A * 9/1993 Konishi ..... 84/477 R
6,310,279 B1 * 10/2001 Suzuki et al. ..... 84/600
6,831,220 B2 * 12/2004 Varme ..... 84/483.2

* cited by examiner

*Primary Examiner*—Kimberly Lockett

(74) *Attorney, Agent, or Firm*—Notaro & Michalos PC

(57) ABSTRACT

The invention concerns a method for the program-controlled visually perceivable representation of a music composition on the display of an electronic device. For this purpose, the music composition is reproduced on the display by a multitude of pre-determined 2D and/or 3D-color elements which are equal to the number of tones and/or meters of the music composition and which are configured in each case in such a manner that the background of every color element is formed in a basic color which is assigned to the major or minor key of the tone and/or meter which corresponds to the color element in a special color circle of fifths of the basic colors of all major and minor keys which has twelve colored circular segments 1 to 12 respectively 13 to 24 per semi-circle to which always one major and the corresponding minor key is assigned. In addition, one of twelve basic colors, which are different from one another, is assigned to every segment of every semi-circle of the color circle of fifths whereby the sequence of the selected twelve different basic colors of the segments 1 to 12 and the segments 13 to 24 is the same and the sequence of the selected twelve basic colors within the twelve segments of every semi-circle can be varied. The tones and/or meters are characterized on the display in a color of the color elements which is taken in accordance with the position of the tone in each case on the scale of the major or minor key of the musical bar from an assigned color key scale.

17 Claims, 30 Drawing Sheets

The colour circle of fifths of the basic colours
of all major and minor keys

The colour circle of fifths of the basic colours
of all major and minor keys

Table of all major keys and the distribution of colours to the relevant tone levels.
The colour of the first level is the same as the basic colour.

| major key / colour | D double flat 25 | C 1 | A double flat 29 | G 3 | E double flat 31 | D 5 | B double flat 33 | A 7 | F flat 35 | E 9 | C flat 37 | B 11 | G flat 39 | F sharp 13 | D flat 41 | C sharp 15 | A flat 43 | G sharp 17 | E flat 45 | D sharp 19 | B flat 47 | A sharp 21 | F 49 | E sharp 23 | major key / colour |
|---|---|---|---|---|---|---|---|---|---|---|---|---|---|---|---|---|---|---|---|---|---|---|---|---|---|
| green 51 | I | I | | VII | II | | | VI | III | | IV | | V | V | | IV | | III | VI | | | II | VII | | green 51 |
| turquoise 62 | | VII | II | | | VI | III | | IV | | V | V | | IV | | III | VI | | | II | VII | | I | I | turquoise 62 |
| cobalt-blue 61 | II | | | VI | III | | IV | | V | V | | IV | | III | VI | | | II | VII | | I | I | | VII | cobalt-blue 61 |
| violet-blue 60 | | VI | III | | IV | | V | V | | IV | | III | VI | | | II | VII | | I | I | | VII | II | | violet-blue 60 |
| violet 59 | III | | IV | | V | V | | IV | | III | VI | | | II | VII | | I | I | | VII | II | | | VI | violet 59 |
| violet-red 58 | IV | | V | V | | IV | | III | VI | | | II | VII | | I | I | | VII | II | | | VI | III | | violet-red 58 |
| purple 57 | V | V | | IV | | III | VI | | | II | VII | | I | I | | VII | II | | | VI | III | | IV | | purple 57 |
| vermilion 56 | | IV | | III | VI | | | II | VII | | I | I | | VII | II | | | VI | III | | IV | | V | V | vermilion 56 |
| orange-red 55 | | III | VI | | | II | VII | | I | I | | VII | II | | | VI | III | | IV | | V | V | | IV | orange-red 55 |
| orange-yellow 54 | VI | | | II | VII | | I | I | | VII | II | | | VI | III | | IV | | V | V | | IV | | III | orange-yellow 54 |
| yellow 53 | | II | VII | | I | I | | VII | II | | | VI | III | | IV | | V | V | | IV | | III | VI | | yellow 53 |
| yellow-green 52 | VII | | I | I | | VII | II | | | VI | III | | IV | | V | V | | IV | | III | VI | | | II | yellow-green 52 |

Fig. 27

Table of all minor keys and the distribution of colours to the relevant tone levels.
The colour of the third level is the same as the basic colour.

| minor key / colour | B double flat 26 | A 2 | F flat 30 | E 4 | C flat 32 | B 6 | G flat 34 | F sharp 8 | D flat 36 | C sharp 10 | A flat 38 | G sharp 12 | E flat 40 | D sharp 14 | B flat 42 | A sharp 16 | F 44 | E sharp 18 | C 46 | B sharp 20 | G 48 | F double sharp 22 | D 50 | C double sharp 24 | minor key / colour |
|---|---|---|---|---|---|---|---|---|---|---|---|---|---|---|---|---|---|---|---|---|---|---|---|---|---|
| green 51 | III | III | | II | IV | | | I | V | | VI | | VII | VII | | VI | | V | I | | | IV | II | | green 51 |
| turquoise 62 | | II | IV | | | I | V | | VI | | VII | VII | | VI | | V | I | | | IV | II | | III | III | turquoise 62 |
| cobalt-blue 61 | IV | | | I | V | | VI | | VII | VII | | VI | | V | I | | | IV | II | | III | III | | II | cobalt-blue 61 |
| violet-blue 60 | | I | V | | VI | | VII | VII | | VI | | V | I | | | IV | II | | III | III | | II | IV | | violet-blue 60 |
| violet 59 | V | | VI | | VII | VII | | VI | | V | I | | | IV | II | | III | III | | II | IV | | | I | violet 59 |
| violet-red 58 | VI | | VII | VII | | VI | | V | I | | | IV | II | | III | III | | II | IV | | | I | V | | violet-red 58 |
| purple 57 | VII | VII | | VI | | V | I | | | IV | II | | III | III | | II | IV | | | I | V | | VI | | purple 57 |
| vermilion 56 | | VI | | V | I | | | IV | II | | III | III | | II | IV | | | I | V | | VI | | VII | VII | vermilion 56 |
| orange-red 55 | | V | I | | | IV | II | | III | III | | II | IV | | | I | V | | VI | | VII | VII | | VI | orange-red 55 |
| orange-yellow 54 | I | | | IV | II | | III | III | | II | IV | | | I | V | | VI | | VII | VII | | VI | | V | orange-yellow 54 |
| yellow 53 | | IV | II | | III | III | | II | IV | | | I | V | | VI | | VII | VII | | VI | | V | I | | yellow 53 |
| yellow-green 52 | II | | III | III | | II | IV | | | I | V | | VI | | VII | VII | | VI | | V | I | | | IV | yellow-green 52 |

Fig. 28

Fig. 29a
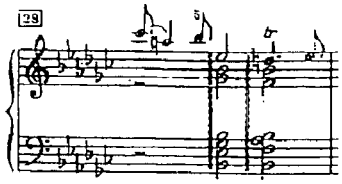
Johann Sebastian Bach, Well-Tempered Clavier, 1st Vol., Prelude VIII, E flat minor, three-two time, 28th bar
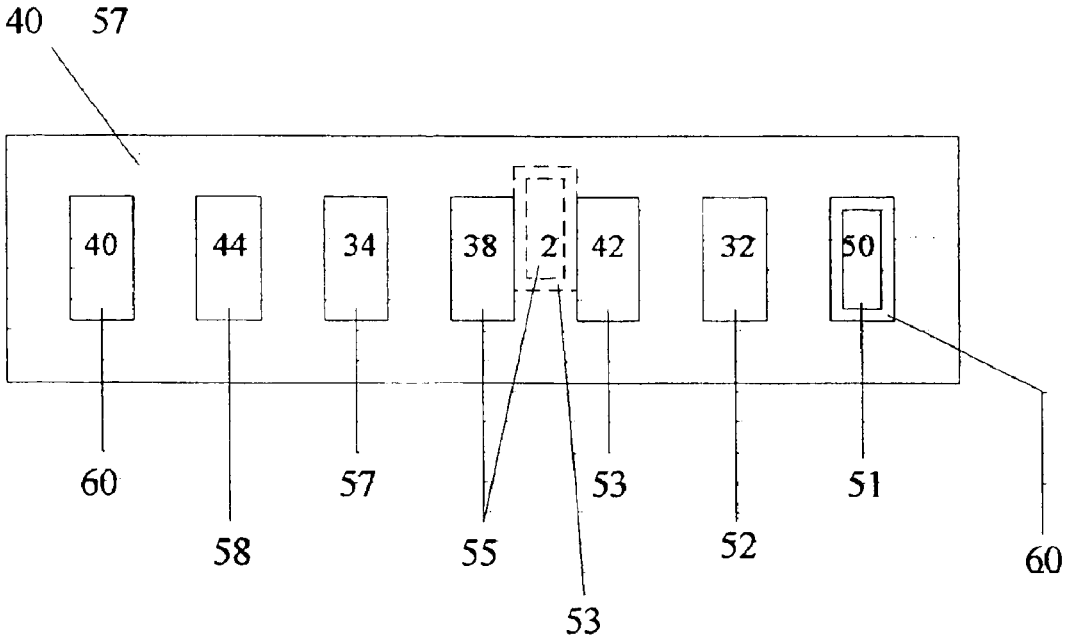
Fig. 29b Fig. 30a
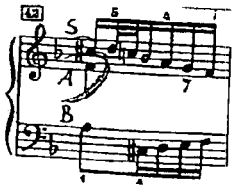
Johann Sebastian Bach, Well-Tempered Clavier, 1st Vol., Fugue XI, a 3 Voci, F major, three-eight time, 42nd bar
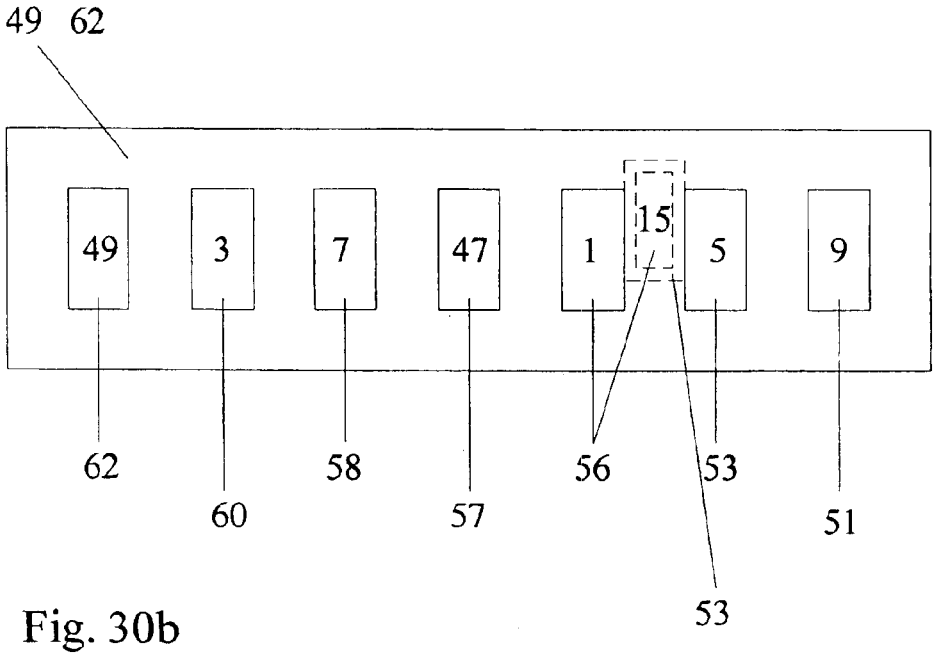
Fig. 30b Fig. 31a
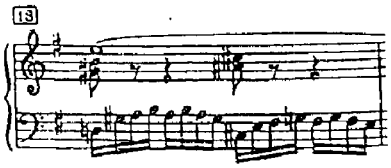
Johann Sebastian Bach, Well-Tempered Clavier, 1st Vol., Prelude X, E minor, four-four time, 18th bar
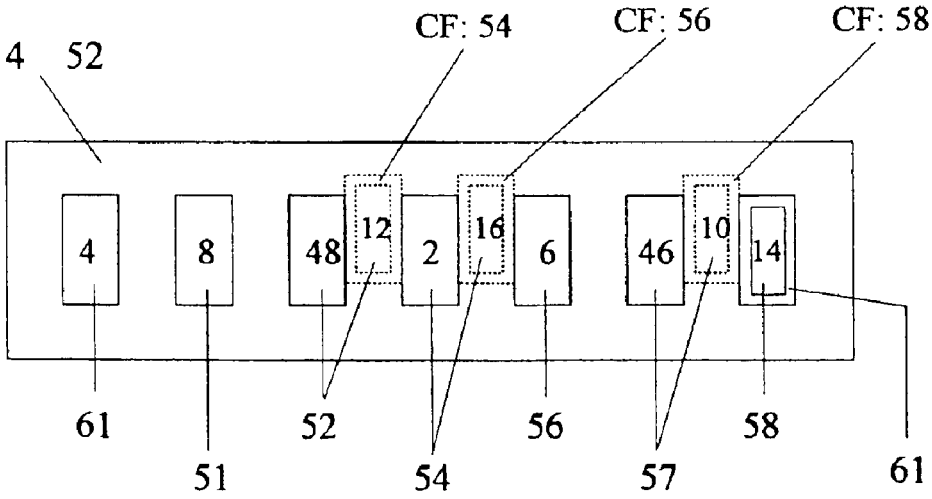
Fig. 31b J. S. Bach, Prelude X, four-four time, e minor, 7th bar J. S. Bach, Prelude X, four-four time, e minor, 7th bar J. S. Bach, Prelude X, four-four time, e minor, 7th bar J. S. Bach, Prelude X, four-four time, e minor, 7th bar
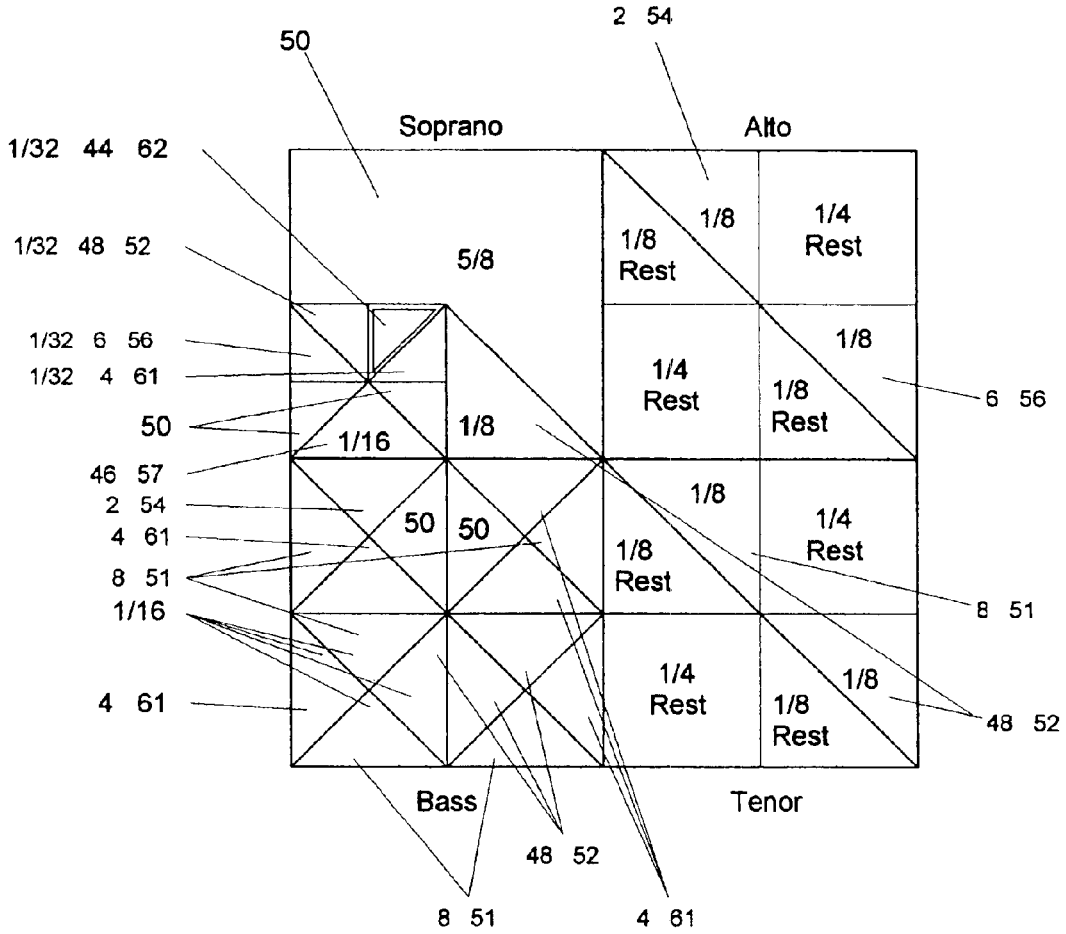
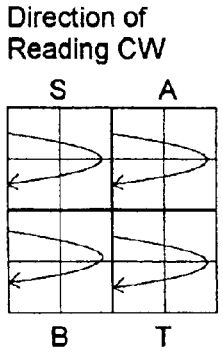
| S | |
|---|---|
| 1/4 | 2/4 |
| 4/4 | 3/4 |
Fig. 36

METHOD FOR THE PROGRAM-CONTROLLED VISUALLY PERCEIVABLE REPRESENTATION OF A MUSIC COMPOSITION

FIELD AND BACKGROUND OF INVENTION

The invention concerns a method for the program-controlled visually perceivable representation of a music composition on the display of an electronic device by means of control electronics integrated into the latter which is equipped with a processor.

The visually perceivable representation of acoustical recordings, to include music compositions, in form of oscillation diagrams on the display of an electronic device and their simultaneous acoustical reproduction is well known. With the U.S. 2002/0138523A1, an electronic device for the color image display of music tones on a monitor or screen with colors, selected from a color palette created by an artist/musician, for every music tone is known, whereby a processor is designed in such a manner that in it at least one palette representing the selected colors can be stored and digital signals can be recorded in it which represent the selected colors or music tones and that the processor produces signals which represent the colors selected from the stored color palette und transfers them to the monitor for the pictorial reproduction of the selected music tones in form of selected colors.

In addition, a procedure for the conversion of tones into colors (DE 11 09 030A) is known—whereby a certain basic color corresponds with every tone of a key note octave—by means of a microphone which functions with the insertion of a solenoid acting upon a vibrating system for the conversion of the tones into colors. The vibrating system possesses several lamellae of which each is assigned to a certain frequency and each has a reflecting area such that every lamella which, under the effect of the resonance between its own frequency and the respective tone of this frequency, has started to vibrate reflects a colored bundle of light rays which produces a respective color effect on a screen.

OBJECTS OF THE INVENTION

The invention is based on the task to make available a method of the aforementioned type with which it is possible to reproduce the music composition, especially a telephone or cell phone ring tone sequence, on the display of an electronic device, especially a cell phone, in a visually perceivable form, i.e. as two-dimensional and/or three-dimensional color elements which either alone or in a puzzle-shaped combination provide an optically perceivable 2D- or 3D-color configuration related to the music composition. With this especially the species of time, the key, the note values and/or the rests, as well as the number of musical parts of the musical bar shall each time be optically perceivable per musical bar as long as one likes.

SUMMARY OF THE INVENTION

According to the invention, this task is solved by both the technical science resulting from patent claim 1 as well as the technical science resulting from patent claim 6.

Advantageous designs of the procedure according to invention result from patent claims 2 to 5 and 7 to 11.

With the procedure according to invention the visually perceivable reproduction of, e.g., a ring tone sequence on the display of a cell phone in varied colored 2D- and/or 3D-profile outline respectively contour is possible which is in each case pre-determined, whereby especially a successive color puzzle configuration of the colored 2D- and/or 3D-profile outline respectively contour-configuration characterizing the ring tone sequence is of advantage for an optically well coverable signal effect of the display.

A particularly advantageous development of the method according to invention is characterized in that vice versa color elements of color-images, color-photos, or any 2D-profile outlines respectively rosette-shaped color graphics, respectively a colored body, or any colored 3D-contours which are produced two- and/or three-dimensionally on the display of the electronic device, especially the cell phone, are electronically recorded and converted, on the basis of their basic color, into acoustically perceivable tones, chords, and/or tone and meter sequences of musical compositions, especially the cell phone ring tone sequence, in accordance with each assignment of the two- and/or three-dimensional color element to the respective segments under the segments 1. to 12. respectively 13. to 24. of the color circle of fifths from basic colors as well as in accordance with the assigned color key scale of the set 48 color key scales and in accordance with the keys assigned to the segments respectively the colors of the color circle of fifths in a program-controlled manner.

According to the invention, this advantageous procedure may, e.g., be used with regard to cell phones for the program-controlled puzzle-shaped construction of the colored picture of a call number's holder of a first cell phone, which is stored on the memory chip of a second cell phone together with the cell phone ring tone sequence assigned according to invention when dialing the call number of the second cell phone from the first cell phone, on the display of the second cell phone in accordance with the stored ring tone sequence, whereby the ring tone sequence can be acoustically and/or in print perceivable. In addition, this procedure may also be used according to invention in form of an electronic color paint box for composing a music composition by using the set color circle of fifths, the set color key scales und the tones, chords, and/or musical bars as well as major and/or minor keys assigned to these color key scales.

Advantageous is that for the visually perceivable display of all the parts of a music composition the rosette-shaped color graphic of every musical bar of the music composition can be arranged with a multitude of concentric circular rings which conform to the number of the parts of the music composition whereby the pitch of the individual parts is assigned to the concentric circular rings in such a manner that, beginning from the innermost circular ring to the outermost circular ring, the part descends from the in each case highest register to the in each case lowest register of the musical bar.

A graphic symbol which makes the species of time of the relevant musical bar in each case stand out optically is preferred in the center of the rosette-shaped color graphic.

A cell phone or an electronic watch, in whatever design is required, is preferably chosen as an electronic device whereby the face of the electronic watch is used for the program-controlled, visually perceivable representation of always one rosette-shaped color graphic according to the musical bar, assigned in each individual case, of the music composition. Thereby the control of the visually perceivable representation of individual musical bars can be such that the presentation of the respective rosette-shaped color graphic on the display of the electronic watch changes from one minute to the next or from hour to hour in accordance with the sequence of the musical bars of the composition.

Principally, every musical bar is displayed as a circle or a circular ring in the building up of the rosette-shaped color graphic which according to the species of time is divided into two (2/8; 2/4; 2/2 time), three (3/8, 3/4 time) or four equal parts (4/8; 4/4 time) etc.

The note values such as a sixteenth note, an eighth note, a quarter note, a half note, a whole note, dotted notes, and pauses etc. are not graphically made visible in the traditional form they are written, but in their concrete time lengths. For example, in a 4/4 time a quarter note extends over a quarter of a circle, a half note over a semi-circle, a dotted half note over three quarters of a circle, and a whole note over the entire circle. But the quarter note in a 3/4 time extends over a third of the circle.

The colors of all keys of the large circle of fifths and the scale belonging to them are fixed in a color system in the form of a color circle of fifths, whereby a specific base color is assigned to every major and minor key. According to musical laws, the colors assigned to a scale of the key are fixed in colored key scales depending on the basic colors. The color circle of fifths ensures that the colors assigned to the tones of a complex music composition as well to the tones of a simple melody "sound", so to speak, colorful, that is tuned, on the background of a basic color assigned to a certain type of key. By means of the color circle of fifths which forms the basis for the construction of the color key scales it is achieved that the quality of the resulting color harmony is constantly relatively uniform no matter in which key it is. In spite of the great variety of the colors (a maximum of 7 colors per musical bar) no respective color scale is ever arbitrarily colorful.

The method according to the invention makes possible to display any given musical bar, e.g. from the area of classical as well as modem music, in the form of a special color graphic on the display of an electronic device in an optically perceivable manner. The color circle of fifths which was particularly developed for the method according to the invention is constructed in accordance with musical laws and oriented strictly to the circle of fifths of musical theory. Since all colors used are subject to a color schema and are thus not arbitrarily chosen, the optical color effect of the rosette-shaped color graphic which can be displayed in succession, e.g. on the face of an electronic watch, are similarly harmonic for all assigned keys. Every rosette-shaped color graphic assigned to a musical bar can be, if required, led back into the respective note picture in an electronic manner in a way that is known and be reproduced in an acoustically perceivable manner. Pertinent sensor systems can be applied for this by the use of infrared-interfaces, transmitter-receiver-systems and/or digitalized methods.

The method according to invention may also be applied for the configuration of display-like electronic learning material by the normal note picture reproduction of a music composition on the display in a manner that every note head is presented in a color which corresponds with its level on the color key scale of a certain key whereby the entire sheet of music visible on the display is kept in the basic color of the relevant key. Such a visually perceivable display facilitates the learning of notes optically and didactically since, e.g., one and the same note in different clefs and octave-levels is quickly recognizable by reason of one and the same color.

According to invention, the method in accordance with the patent claims 1 to 5 or 6 to 9 can be conducted in a manner that vice versa two-dimensional and/or three-dimensional color elements of color images, color photos or any predetermined 2D-profile outlines respectively a rosette-shaped color graphic respectively a colored body or any colored predetermined 3-D contours generated on the display of the electronic device, especially the cell phone, are electronically recorded and are converted, on the basis of their basic color, into acoustically perceivable tones, chords, and/or tone and meter sequences of the music composition, especially the cell phone ring tone sequence, in a program-controlled manner in accordance with the respective assignment of the two- and/or three-dimensional color elements to the in each case corresponding segments under the segments 1. to 12. respectively 13. to 24. of the color circle as well as in accordance with the assigned color key scale of the set 48 color key scales and in accordance with the keys assigned to the segments respectively the colors of the color circle of fifths in a program-controlled manner.

This vice-versa procedure can, according to invention, be applied in form of an electronic color paint box for composing a music composition with the use of the set color circle of fifths, the set color key scales and tones, chords, and/or musical bars as well as major and/or minor keys assigned to them accordingly.

BRIEF DESCRIPTION OF THE DRAWINGS

In the following, the method according to the invention is explained by means of drawings.

These include:

FIGS. 2*a*, 2*b* to 25*a*, 25*b* The construction of the color key scales assigned to the major keys and the parallel minor keys.

FIG. 27 A table of all major keys showing the distribution of colors to the relevant tone levels whereby the color of the first level is the same as the basic color;

FIG. 28 A table of all minor keys showing the distribution of colors to the relevant tone levels whereby the color of the third level is the same as the basic color;

FIG. 29*a* Display of the picture of notes of the $28^{th}$ bar of Prelude No. VIII, in E flat minor, three-two time, from the "Well-Tempered Clavier, $1^{st}$ Vol." by Johann Sebastian Bach;

FIG. 29*b* Display of the color-scale in E flat minor (harmonic) assigned to the $28^{th}$ bar according to FIG. 29*a;*

FIG. 30*a* Display of the picture of notes of the $42^{nd}$ bar of the Fugue XI, a 3 voci, F major, in three-eight time from the "Well-Tempered Clavier, $1^{st}$ Vol." by Johann Sebastian Bach;

FIG. 30*b* A display of the color-scale in F-major assigned to the $42^{nd}$ bar according to FIG. 30*a*

FIG. 31*a* Display of the picture of notes of the 18$^{th}$ bar of the Prelude X, E minor, in four four time from the "Well-Tempered Clavier, 1$^{st}$ Vol." by Johann Sebastian Bach;

FIG. 31*b* Display of the color-scale in E minor assigned to the 18$^{th}$ bar according to FIG. 31*a;*

FIG. 36 A color graphic consisting of four 2D color elements in square form, assigned to the voices soprano, alto, tenor, and bass which reproduces the 7th bar as under FIG. 32;

DESCRIPTION OF THE PREFERRED EMBODIMENTS

Figure 1A:
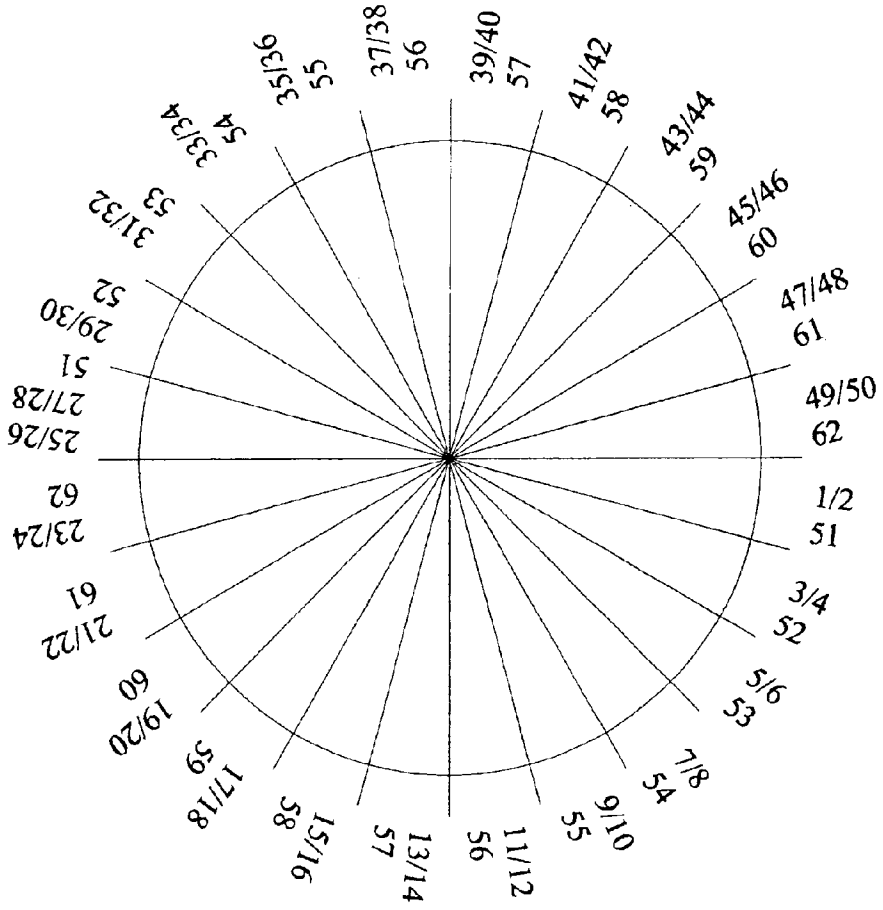
FIG. 1*a* A representation of the color circle of fifths of the basic colors of all major and minor keys.

With the 12 tones of the chromatic scale, theoretically both, 12 sharp keys and 12 B keys in major and minor are available in music. The distribution of the 12 basic colors to the keys of the large circle of fifths is based on this. As is shown in FIG. 1*a* and FIG. 1*b*, the large circle of fifths consists, starting from C major 1, with ascending fifth over G major 3, D major 5, A major 7 etc. to B sharp major 27, the enharmonic key of C major 1, of a right half circle of the sharp keys and with descending fifth over F major 49, B flat major 47, E flat major 45 etc. to D double-flat major 25, the enharmonic key of C major 1, of a left half-circle of the B keys.

Figure 1B:
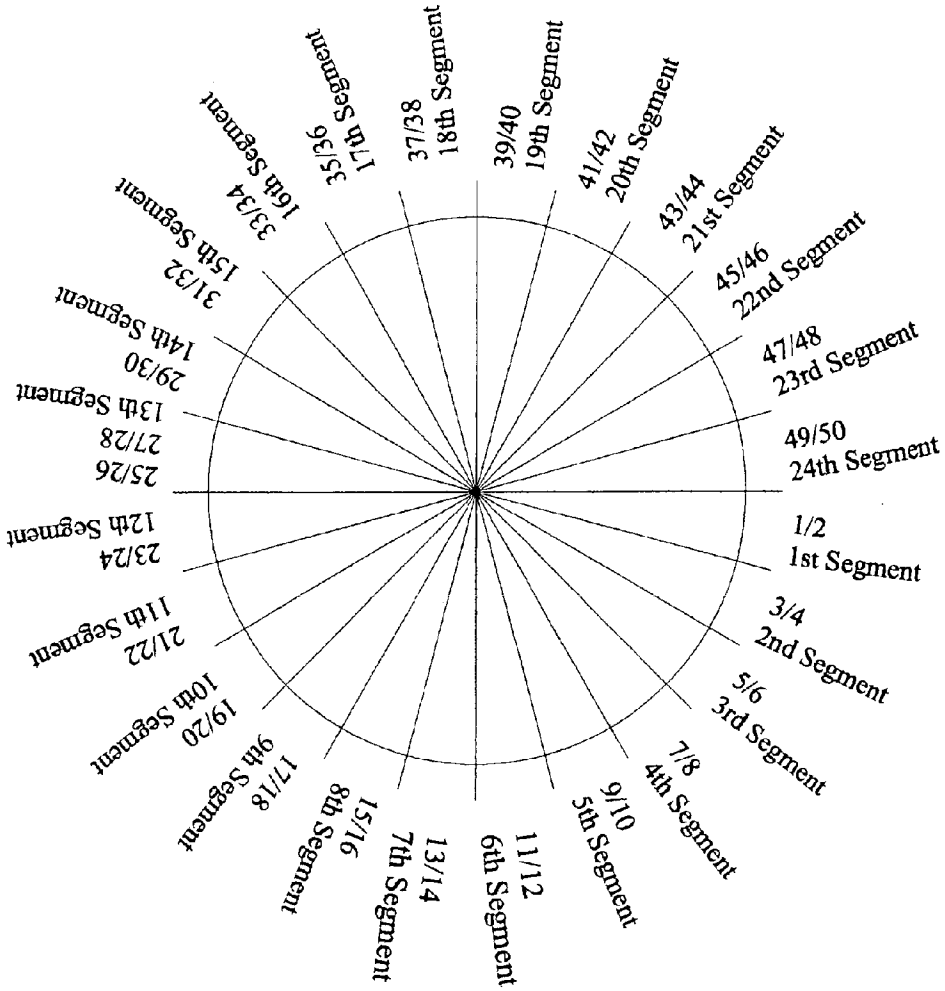
FIG. 1*b* Another representation of the color circle of fifths with all major and minor keys assigned to circular segments to which always one of the twelve unchangeable basic colors which differ from each other is assigned.
Figure 2B:
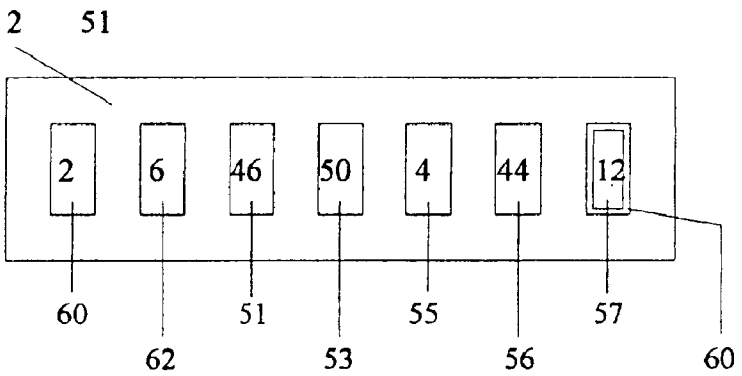
Figure 2A:
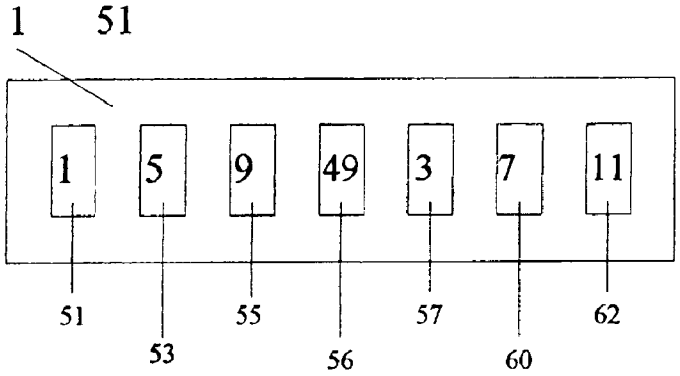
Figure 3B:
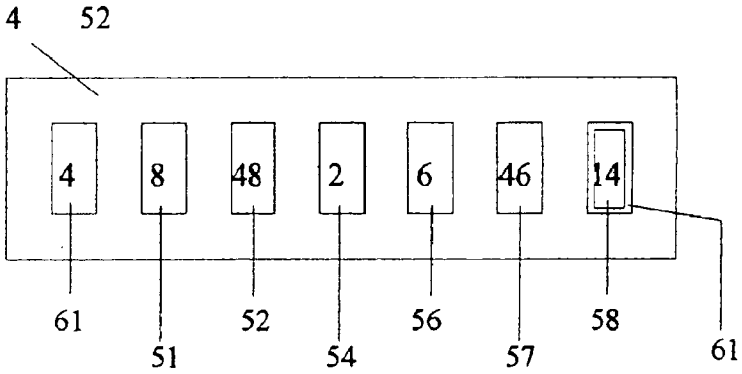
Figure 3A:
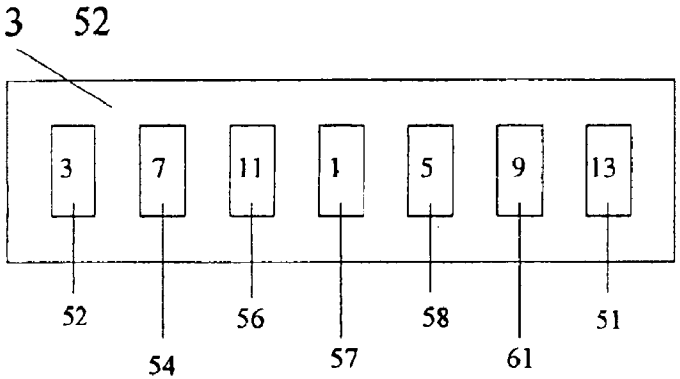
Figure 4B:
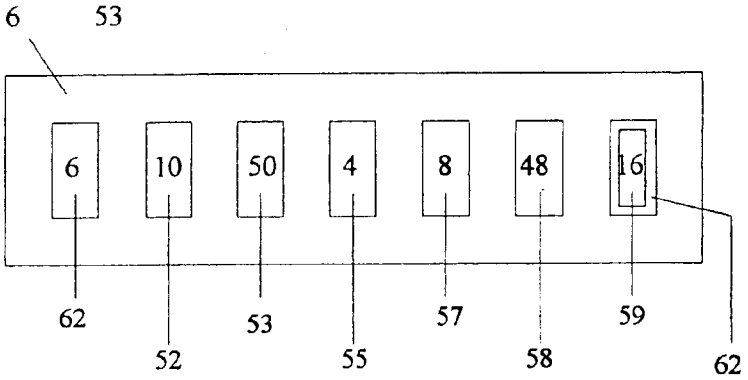
Figure 4A:
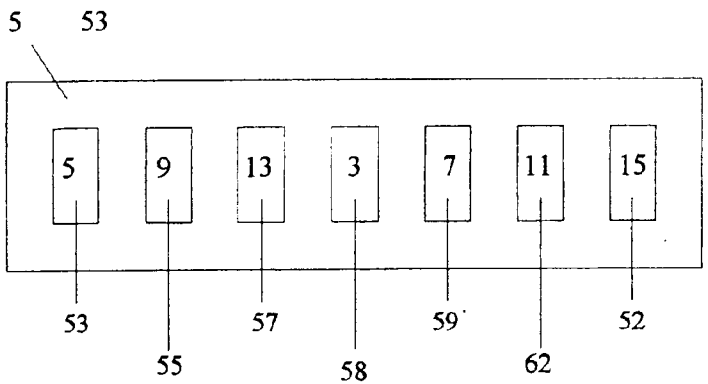
Figure 5B:
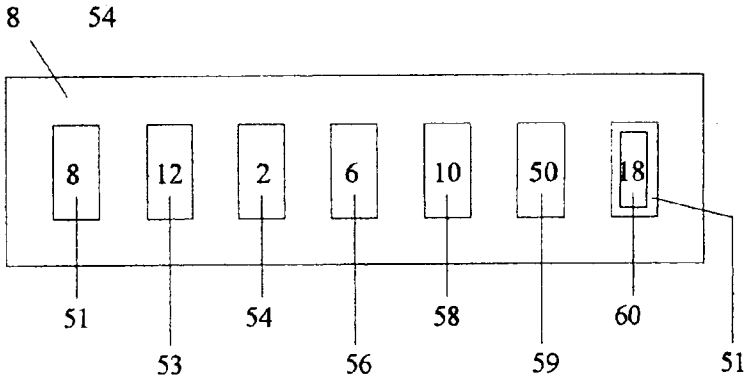
Figure 5A:
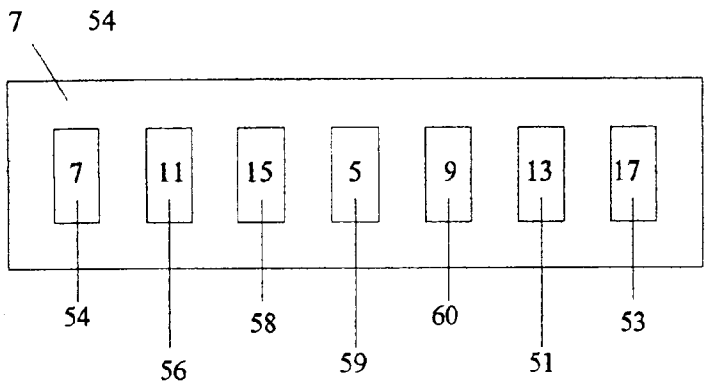
Figure 6B:
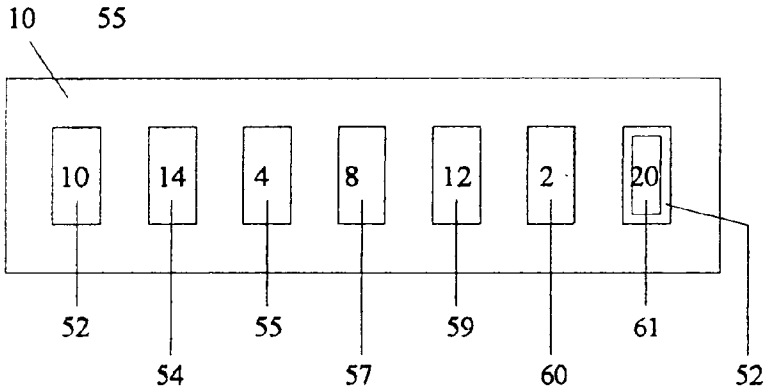
Figure 7B:
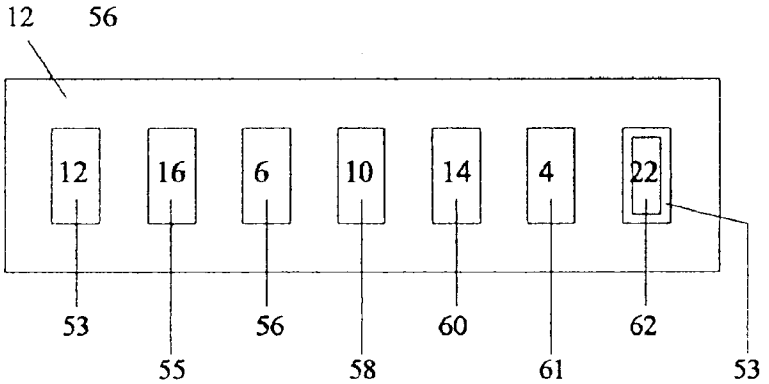
Figure 7A:
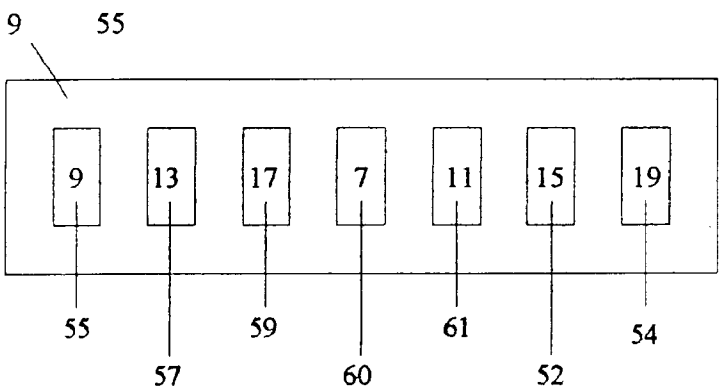
Figure 7B:
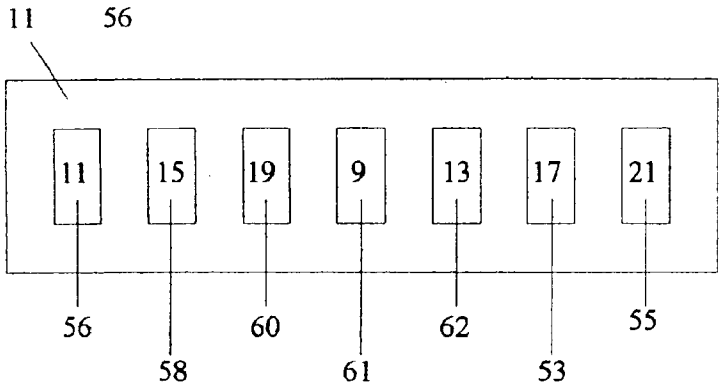
Figure 8B:
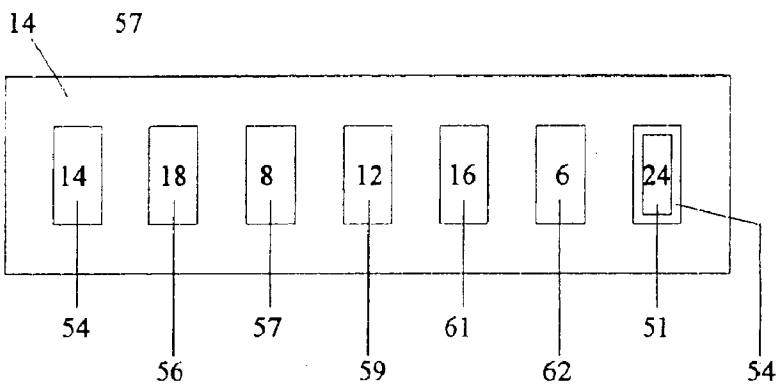
Figure 9B:
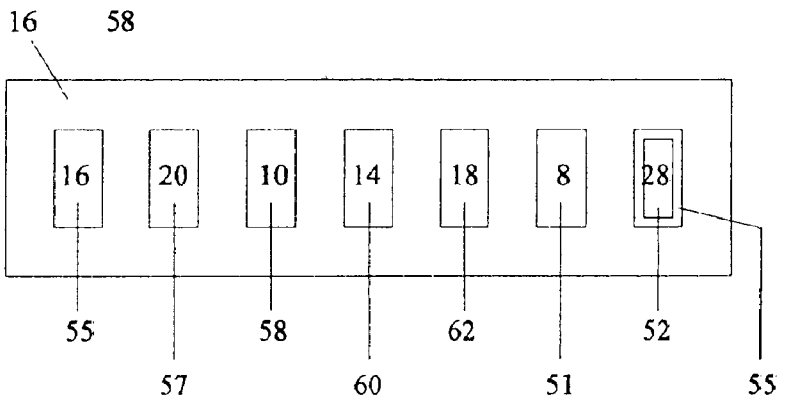
Figure 8A:
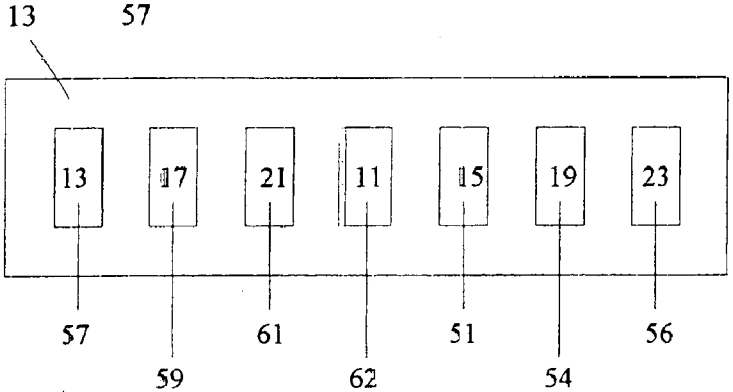
Figure 9A:
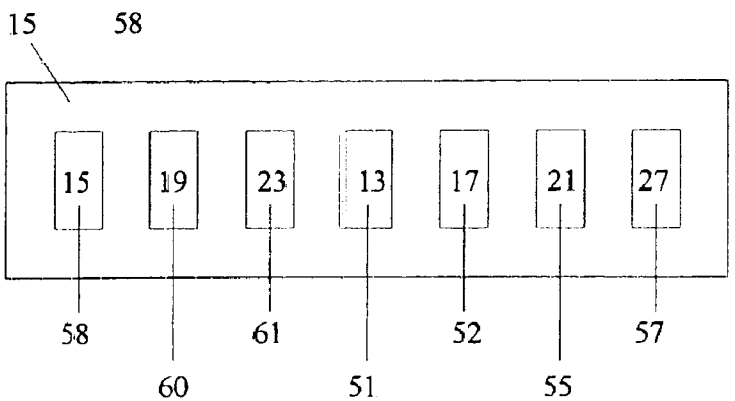
Figure 10B:
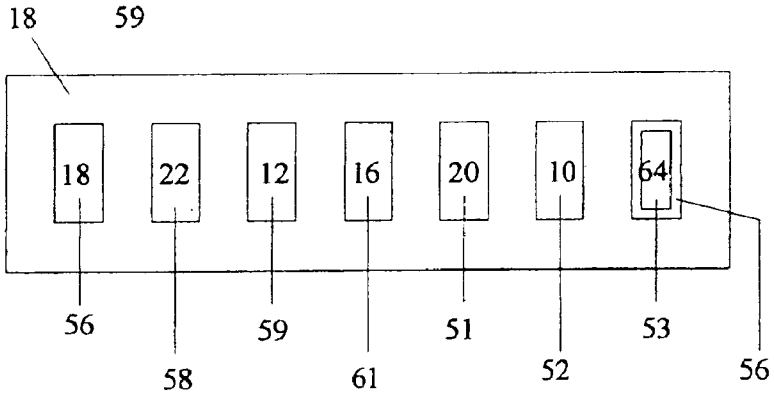
Figure 11B:
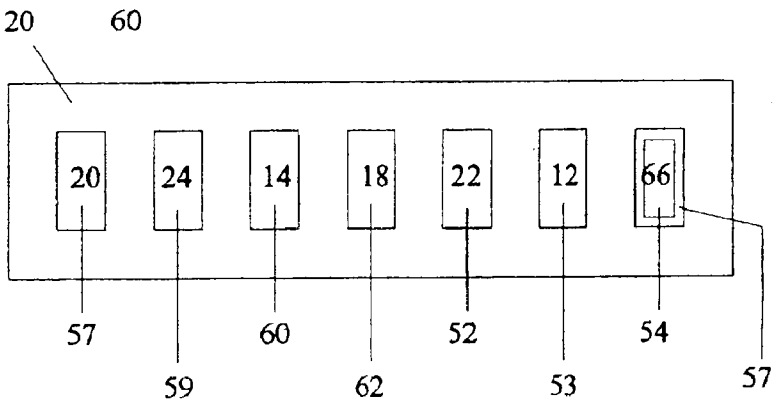
Figure 10A:
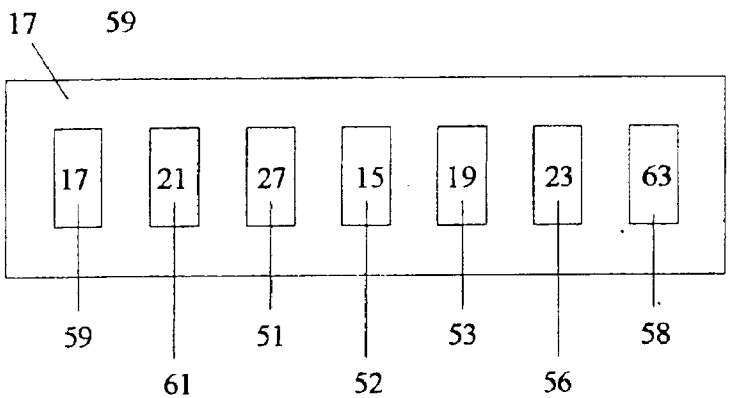
Figure 11A:
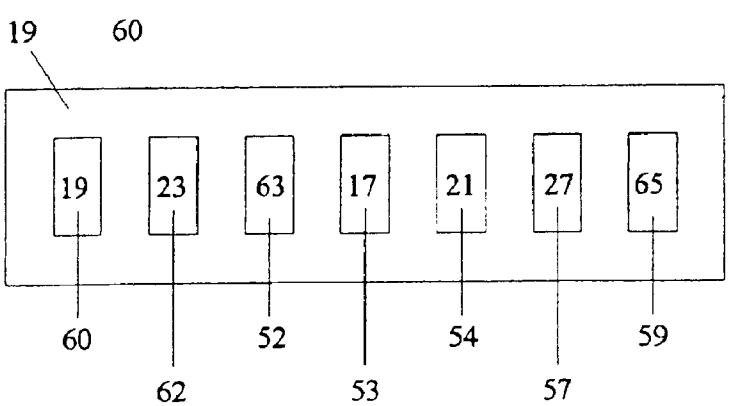
Figure 12B:
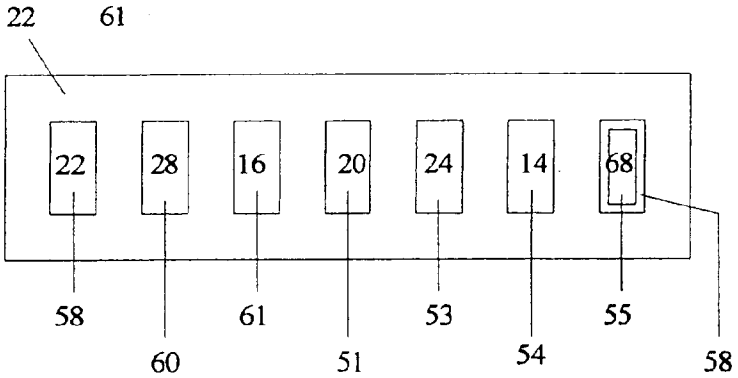
Figure 12A:
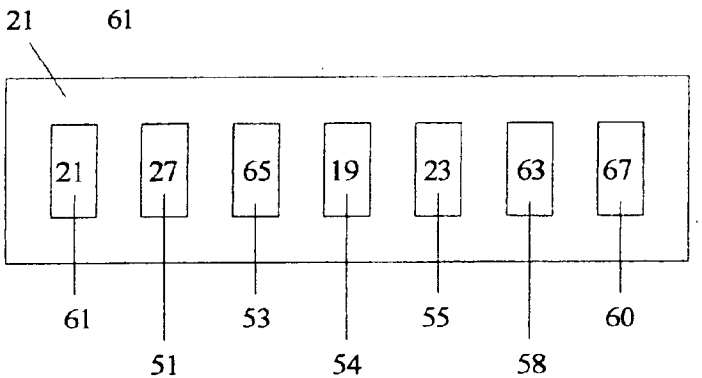
Figure 13B:
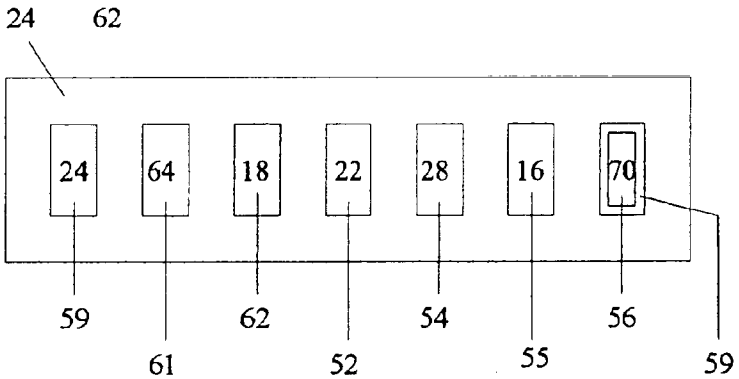
Figure 13A:
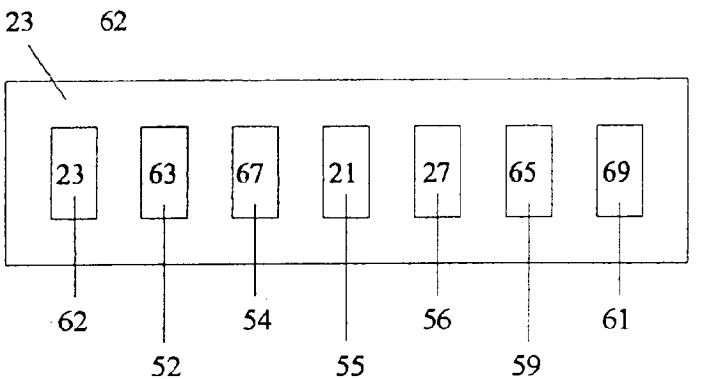
Figure 14B:
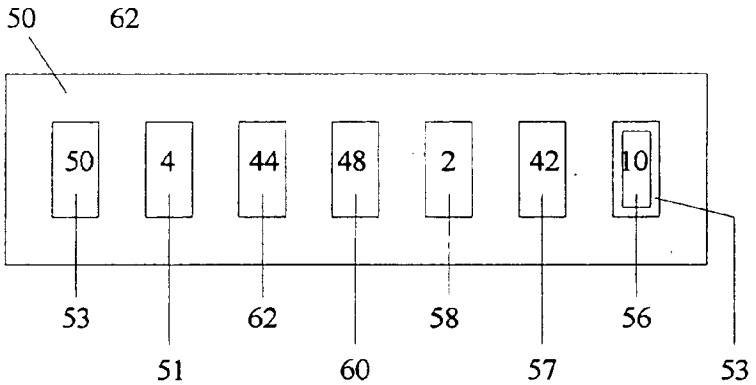
Figure 14A:
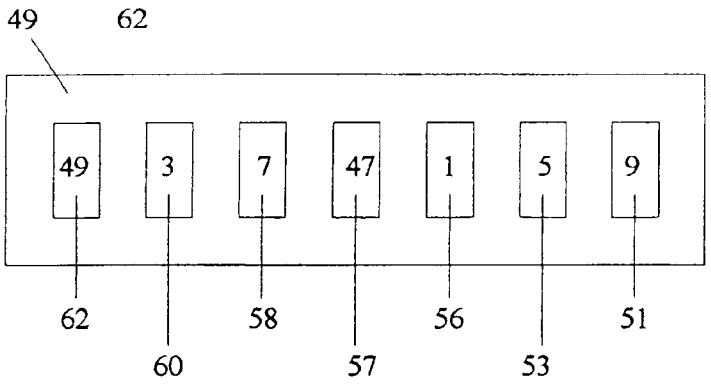
Figure 15B:
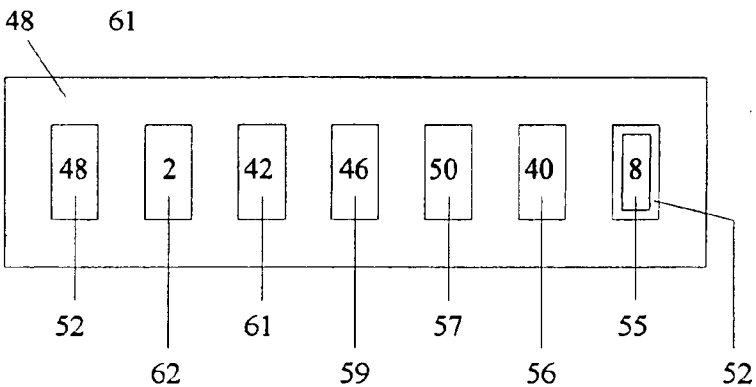
Figure 15A:
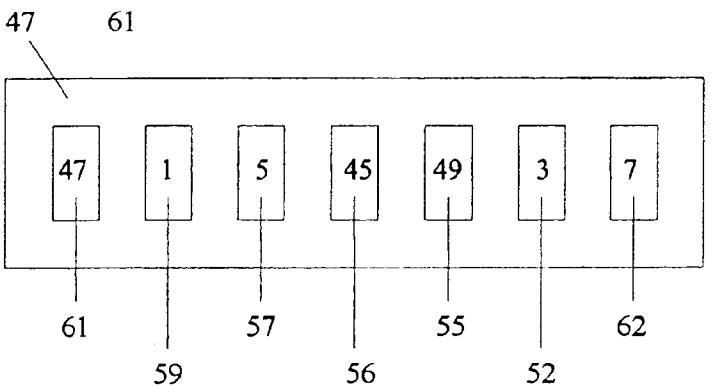
Figure 16B:
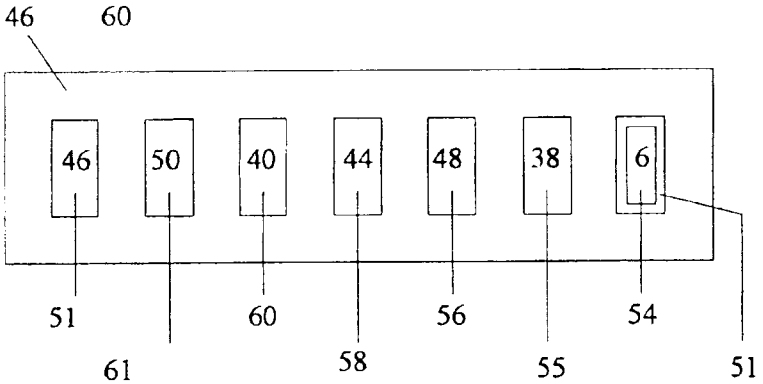
Figure 16A:
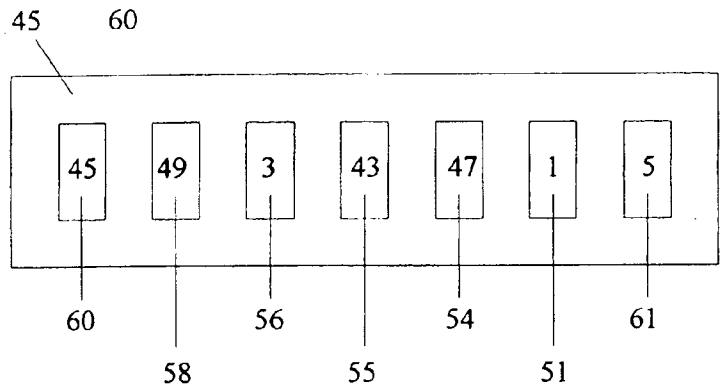
Figure 17B:
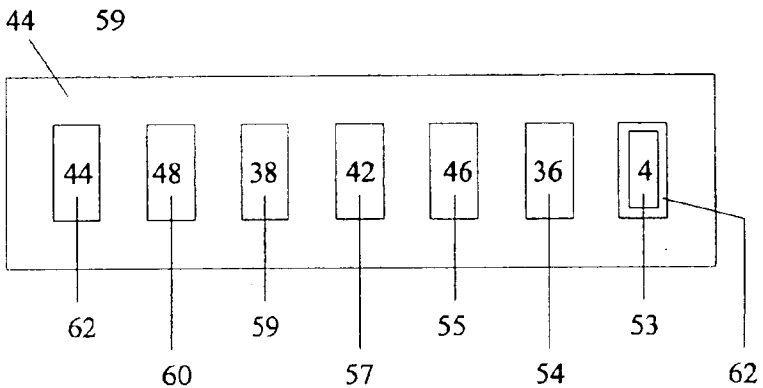
Figure 17A:
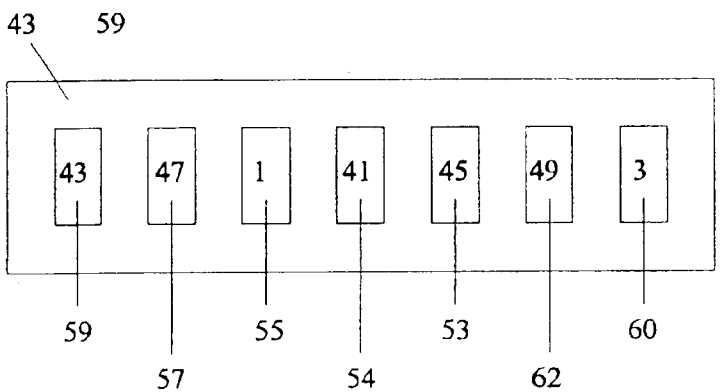
Figure 18A:
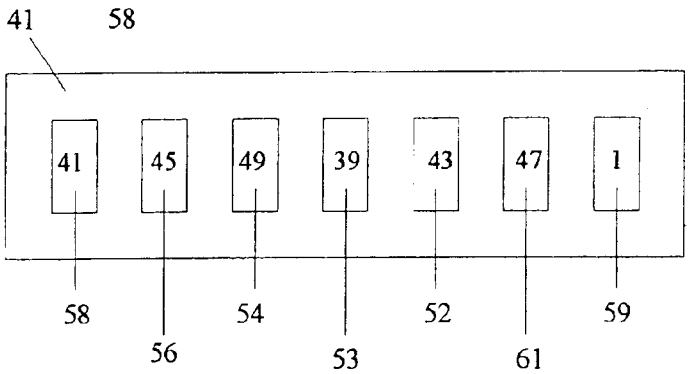
Figure 18B:
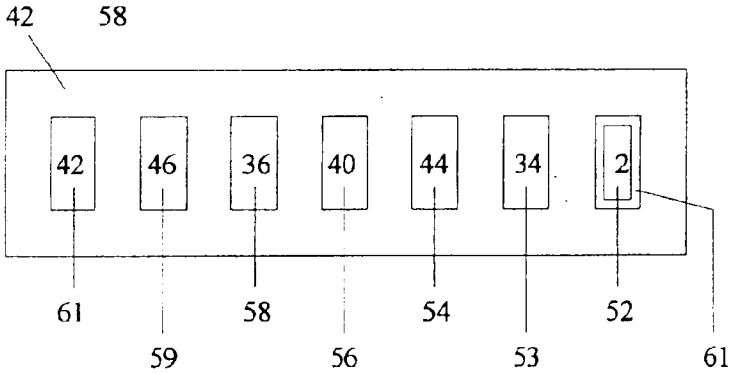
Figure 19A:
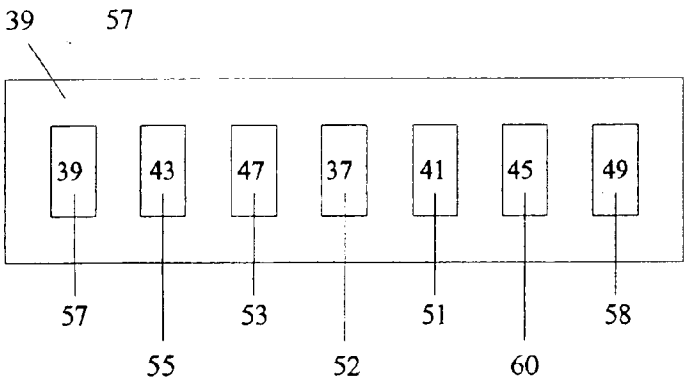
Figure 19B:
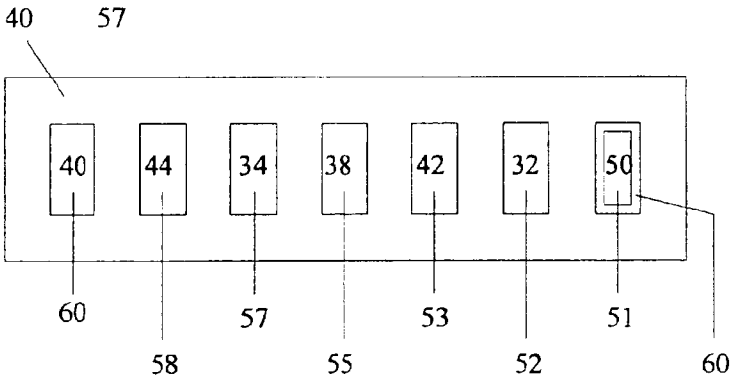
Figure 20B:
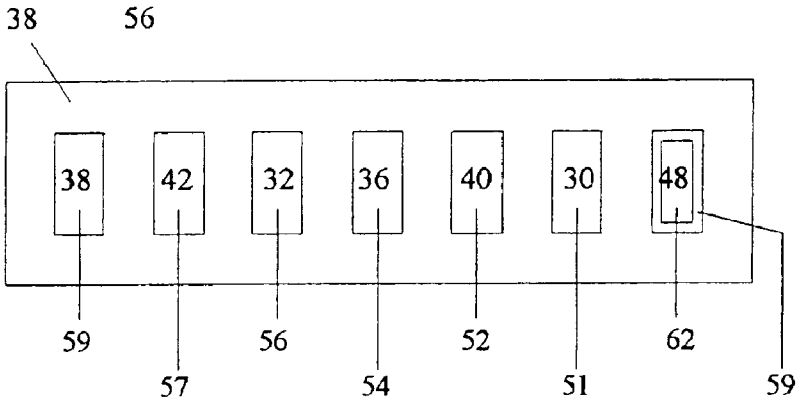
Figure 21B:
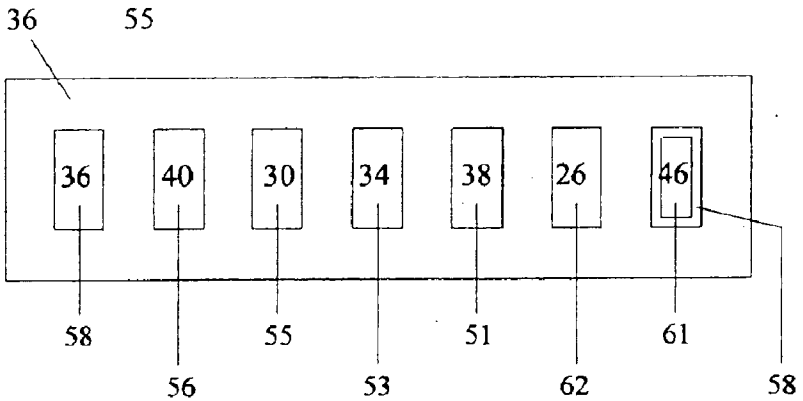
Figure 20A:
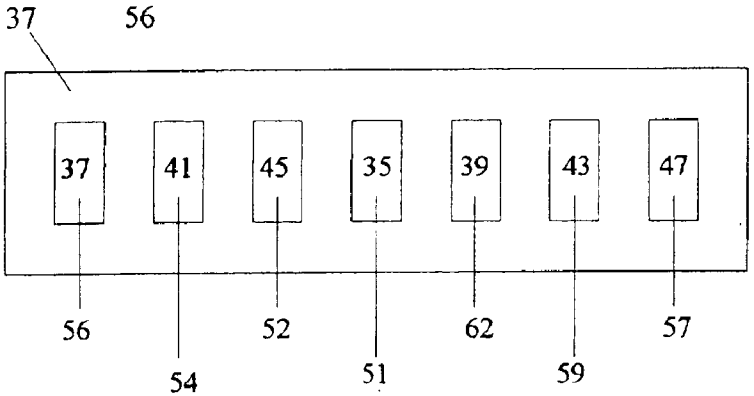
Figure 21A:
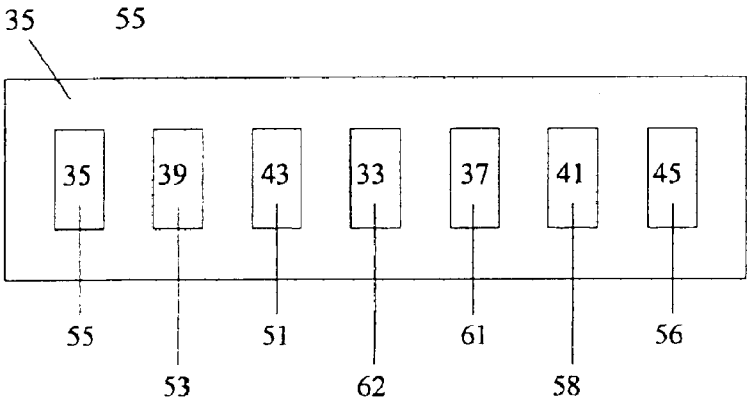
Figure 22B:
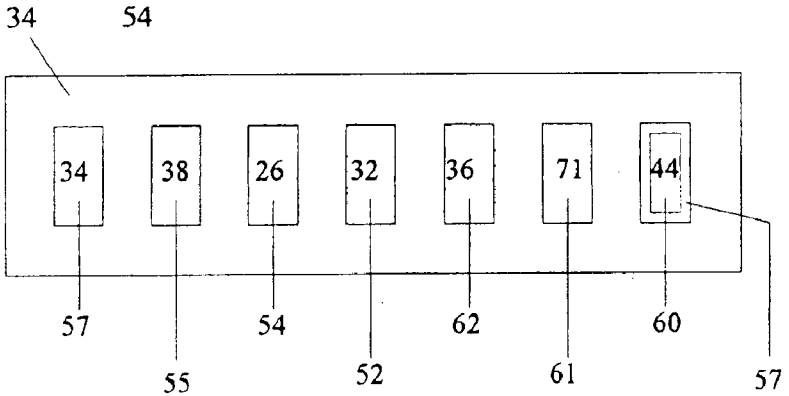
Figure 23B:
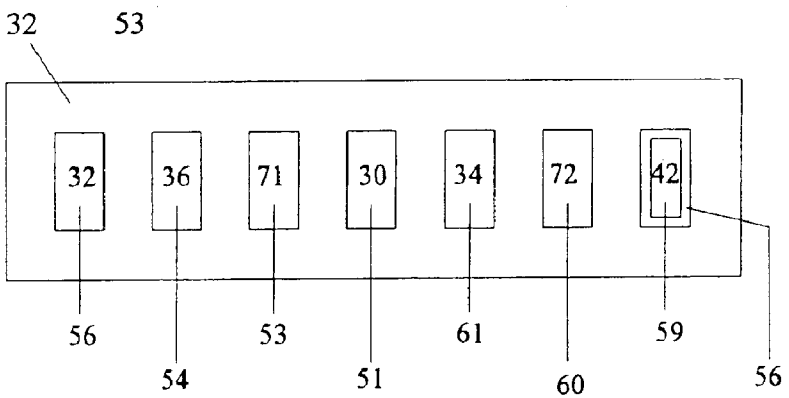
Figure 22A:
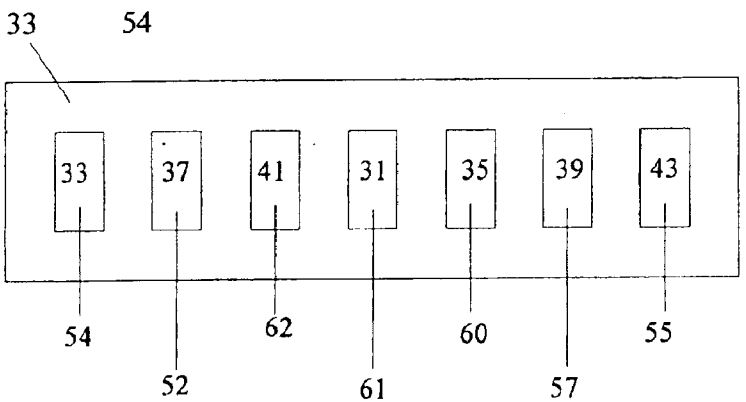
Figure 23A:
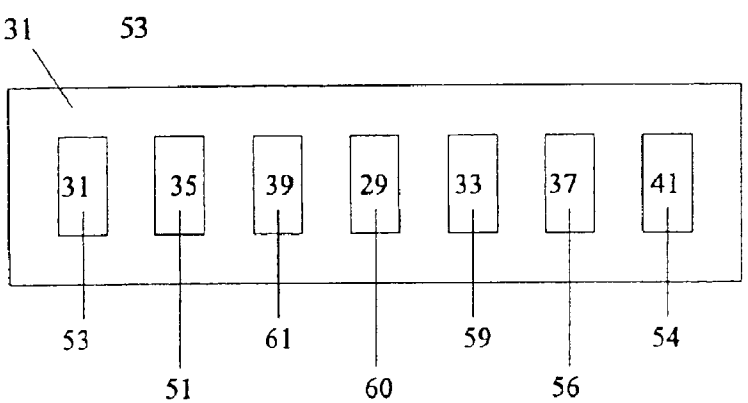
Figure 24A:
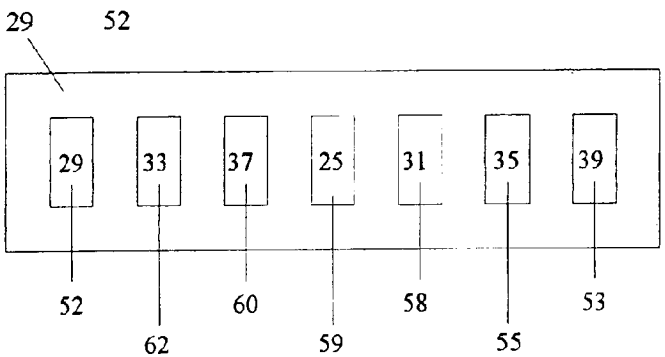
Figure 24B:
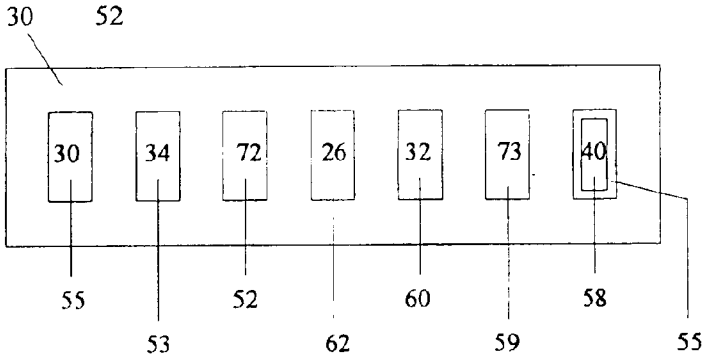
Figure 25A:
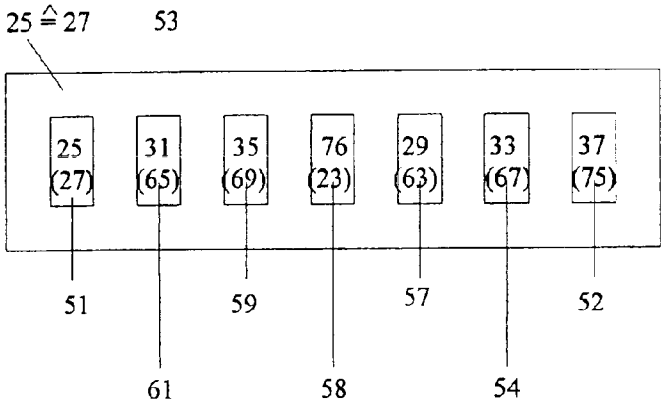
Figure 25B:
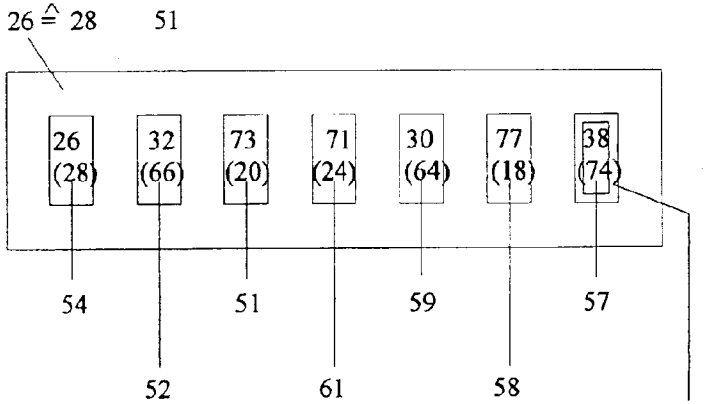

Since D major 5 is, in general, perceived as the lightest and brightest key, the color yellow 53 was assigned to this key at a design of the invention as shown in FIG. 1*a*. The key G sharp major 17 which is the most distant to D major 5 is in a right angle to D major in the color circle of fifths according to FIG. 1*a*. The color violet 59 which is the most distant to the color yellow 53 and which is its complementary color was chosen for G sharp major 17. All keys of the color circle of fifths which are positioned at right angles to each other are assigned to colors which are complementary to each other.

The following colors were, started with D major 5, assigned to the sharp keys in the color circle of fifths: D major 5=yellow 53; A major 7=yellow-orange 54; E major 9=red-orange 55; B major 11=vermilion 56; F sharp major 13=purple 57; C sharp major 15=red-violet (pink) 58; G sharp major 17=violet 59; D sharp major 19=blue-violet 60; A sharp major 21=cobalt-blue 61; E sharp major 23=turquoise 62; B sharp major 27=green 51; F double sharp major (A double-flat major) 63 (72)=yellow-green 52 and C double sharp major (E double-flat major) 65 (71) as enharmonic representative of D major 5=yellow 53.

The following determinations result for B keys when again starting from D major 5 in the color circle of fifths: D major 5=yellow 53; G major 3=yellow-green 52; C major 1=green 51; F major 49=turquoise 62; B flat major 47=cobalt-blue 61; E flat major 45=blue-violet 60; A flat major 43=violet 59; D flat major 41=red-violet 58; G flat major=purple; C flat major=vermilion; F flat major=red-orange; B double-flat major 33=yellow-orange 54 and E double-flat major 31=yellow 53 as enharmonic representative of D major 5. The circle of colors in the direction of the flat keys has closed as shown in FIG. 1*a*. Key and enharmonic representative lie opposite each other on the diameter of the color circle of fifths and the same basic color is assigned to them. Always the same basic color is assigned to the parallel minor keys as is assigned to their related minor keys in each case.

As can be taken from FIG. 1*b* which shows the color circle of fifths of another design of the invention with which a music composition such as the ring tone sequence of a cell phone can be reproduced in a program-controlled manner by a multitude of pre-determined two-dimensional or three-dimensional color elements corresponding to the number of tones and/or times on the display of a cell phone, also another choice than according to FIG. 1*a* of the twelve basic colors which differ from each other is possible in this design. The color circle of fifths according to FIG. 1*b* has twenty-four colored circular segments of the same size, whereby the keys in the color circle of fifths started from the circular segment lying in its zenith are set in relation to the in clock-wise direction successive twenty-four circular segments as follows:

| | |
|---|---|
| C major and A minor = | 1$^{st}$ segment |
| G major and E minor = | 2$^{nd}$ segment |
| D major and B minor = | 3$^{rd}$ segment |
| A major and F sharp minor = | 4$^{th}$ segment |
| E major and C sharp minor = | 5$^{th}$ segment |
| B major and G sharp minor = | 6$^{th}$ segment |
| F sharp major and D sharp minor = | 7$^{th}$ segment |
| C sharp major and A sharp minor = | 8$^{th}$ segment |
| G sharp major and E sharp minor = | 9$^{th}$ segment |
| D sharp major and B sharp minor = | 10$^{th}$ segment |
| A sharp major and F double-sharp minor = | 11$^{th}$ segment |
| E sharp major and C double-sharp minor = | 12$^{th}$ segment |
| B sharp major and G double-sharp minor/ = D double-flat major and BB minor | 13$^{th}$ segment |

-continued

| | |
|---|---|
| A double-flat major and F flat minor = | 14th segment |
| E double-flat major and C flat minor = | 15th segment |
| BB major and G flat minor = | 16th segment |
| F flat major and D flat minor = | 17th segment |
| C flat major and A flat minor = | 18th segment |
| G flat major and E flat minor = | 19th segment |
| D flat major and B minor = | 20th segment |
| A flat major and F minor = | 21st segment |
| E flat major and C minor = | 22nd segment |
| B major and G minor = | 23rd segment |
| F major and D minor = | 24th segment |

One of twelve basic colors which differ from each other and are unchangeable after their selection are assigned to each of the segments 1. to 12. and each of the segments 13. to 24. of the color circle of fifth whereby the sequence of the twelve different basic colors assigned to the segments 1. to 12. and the segments 13. to 24. is always the same for the color circle of fifths. Once the twelve basic colors for the color circle of fifths are selected, this selection is fixed. The number of variation possibilities of the sequence of the basic colors in the segments 1. to 12. respectively the segments 13. to 24. is thus fixed by the twelve circular segments of a semi-circle of the color circle of fifths.

FIGS. 2*a*, 2*b* to 25*a*, 25*b* show the structure of the color scales assigned to the major keys and the parallel minor keys. The scale consists of seven tones and the color scale of seven colors. Every color scale is shown as an unwound color circle consisting of seven parts and stands in visual interaction with the background of a color which corresponds to the basic color of the key to which the color scale is assigned. By the color-background formed by the background, the colors of the color scale are, so to speak, brought to "sound" and unfold their optimal color-aesthetic attraction. The color of the first level of the color scale in major corresponds to the basic color of the relevant key. The basic color of D major 5 is, for example, yellow 53, which means that the first level of the D major 5 scale on the color scale is also yellow 53. Every major color scale builds up on the basic color of its own key.

All minor keys take on the basic color of their parallel major key. Thus the basic color yellow 53 for D major 5 corresponds to the color assigned to the parallel minor key B-minor 6. Contrary to the major key, the color assigned to the first level of the parallel minor key is not identical with the basic color but corresponds—as in musical theory—to the color assigned to the sixth level of its parallel major key. Now, if the first level is yellow 53 in D major 5 and corresponds to the basic color, the color turquoise 62 assigned to the sixth level of D major 5 corresponds to the color assigned to the first level of the parallel minor key B minor 6. From this results that the first level of the minor keys are not identical with the basic color assigned to the latter in each case. Thereby a criterion for the differentiation between major and minor is given within this color system.

For the transfer of another regularity from musical theory to the color system it is determined that two colors, which are at least approximately complementary to each other, are assigned to two tones are in a fifth relation to each other.

In the construction of the major color scale the color of the first level of the major color scale corresponds, as already mentioned, to the basic color assigned to the key belonging to it. Since the fourth level and the fifth level are subdominant and dominant in a fifth-relation to the first level, the complementary color is assigned to the fifth level and an approximate complementary color to the basic color is assigned to the fourth level. These two colors function as "counter-colors" to the basic color "dominant".

In order to complete the major color scale, the fifths have to be inserted in the second and third level such that the color-circle with the seventh level closes again to the eighth level and the first level. All fifth-relations within the major and minor color scales are at least approximately complementary whereby the fifth level of the major color scale shall be clearly complementary to the basic color.

The minor key is in a close relationship to its parallel major key. In the construction of the minor color scale (harmonic minor) the minor key therefore takes on the basic color assigned to the parallel major key and the colors assigned to the seven tones of the parallel major key. However, in contrast to the major color scale, another color-effect results because of the changed position of the tones and colors of the minor color scale in relation to the basic color. The first level of the minor color shade corresponds to the sixth level of the major color scale and is thus not identical with the basic color of the color scale. From this results that the fifth level has no complementary color-effect regarding the basic color. The complementary color contrast of the fourth and fifth level regarding the basic color disappears whereby an important distinctive feature is given between major and minor. The entire color impression appears to be somewhat softer thereby.

Since always the same colors are assigned to all identical tones of the major keys and the parallel minor keys for the harmonization of the color system, the complementary color-pair of the sixth and second level of the major color scale cannot be transferred to the minor color scale because the sixth level major corresponds to the first level minor and the second level major to the fourth level minor. Thus the fourth level minor has the true complementary color effect, while the fifth level has an approximately complementary effect. In other respects, the fifths are built up by complementary and approximately complementary color pairs as is the case in the major color scale, so that the circle of colors again closes from the seventh to the eight level and first level. In FIGS. 2*b* to 25*b*, the raising of the seventh level is in each case characterized by a color frame (CF) in adaptation to the identification of the raising of the seventh level in the harmonic minor scale equivalent to an accidental in the note picture. As regards the raising of tones, the color of the color frame is in each case oriented to the color of the next higher level of the tone to be raised. However, as regards the lowering of tones, the color of the color frame is determined by the next lower level of the tone to be lowered. The seventh level in B minor 6 A is, for example, violet 59. The A becomes a leading tone to A sharp by its raising and obtains a color frame in the color of the eighth and the first level of B minor 6 i.e. in turquoise 62.

The colors of the major and minor color scales always refer to only one major key with the parallel minor key belonging to it. Thus the G 3 in C major 1 has another color (purple 57) than the G 48 in G major 3 (yellow-green 52).

If a music composition is to be represented by means of the rosette-shaped color graphics, the basic color of a key with its own colors will also in case of modulations to related keys not be left since these modulations only confirm the original key. Only a clear leaving of the key by means of new accidentals is made visible by a changed basic color with its own color stages.

All colors assigned to tones, whether these tones are transposed higher or lower, have the same color intensity which renders the overall impression of the relevant color graphic harmonically and easily seen. All Cs in C major 1 are, for example, green 51. The point-system shown in FIG. 26 which orients itself to the octave marks of the notation, serves the exact determination of the position of a tone within the color graphic. A point in the corner of a square colored level-element indicates that the assigned tone is within the once-accented octave. Two points in the corner of a colored level-element indicate that the assigned tone is within the twice-accented octave etc.

A point in the middle of a colored level-element means that the assigned tone is within the small octave. Two points in the middle of the colored level-element mean that the assigned tone is within the great octave. Three points in the middle of the colored level-element indicate that the assigned tone is within the contra-octave and as from four points in the double contra-octave area.

As a matter of convenience and in order to be immediately able to define the position of the tones of a bar, only the initial tones of all entering parts are marked with respective points. The next designation by a point within a part takes place only when a tone leaves its current octave area or when a new bar sets in.

FIG. 27 is a table of all major keys showing the distribution of colors to the relevant tone levels whereby the color of the third level corresponds to the basic color.

FIG. 28 is a table of all minor keys showing the distribution of the colors to the relevant tone levels whereby the color of the third level corresponds to the basic color. Since the seventh level of every harmonic minor keys is raised by half a tone, a so-called color-frame assigned to the next higher level is assigned to the seventh level of the minor color scale. The next higher level is the eighth and the first level. The seventh level of A minor 2 (purple 57) receives, for example, a color frame in the color of the first level (violet-blue), and the seventh level of E minor 4 (violet-red 58) a color frame in the color of the first level (cobalt-blue 61) etc. The colors of the color frames which can be seen in the color scales of the parallel minor keys are not considered in the table according to FIG. 28.

Figure 26:
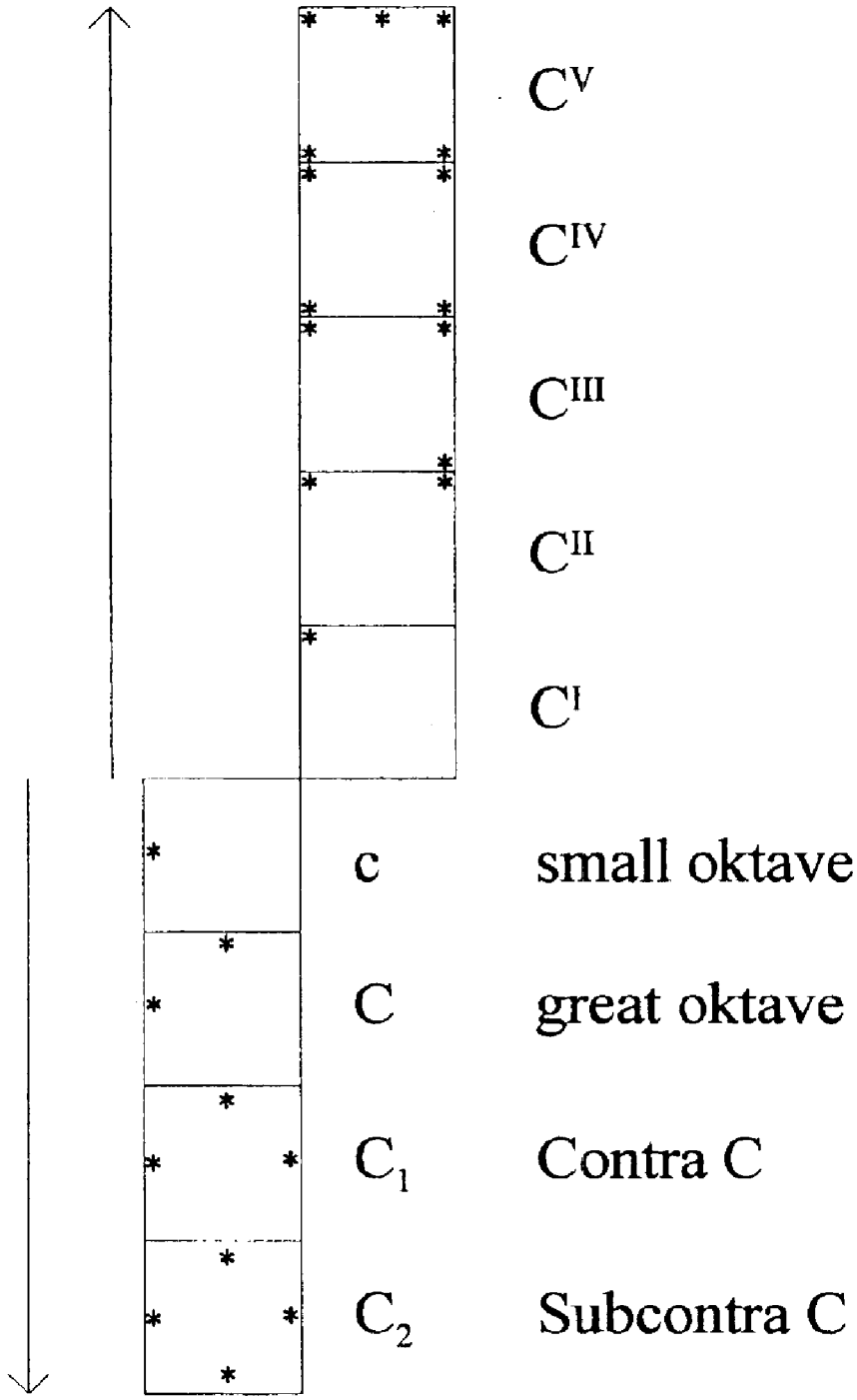
FIG. 26 A graphic display of a pitch-point-system for the determination of the location of each tone.
Figures 29C, 29D:
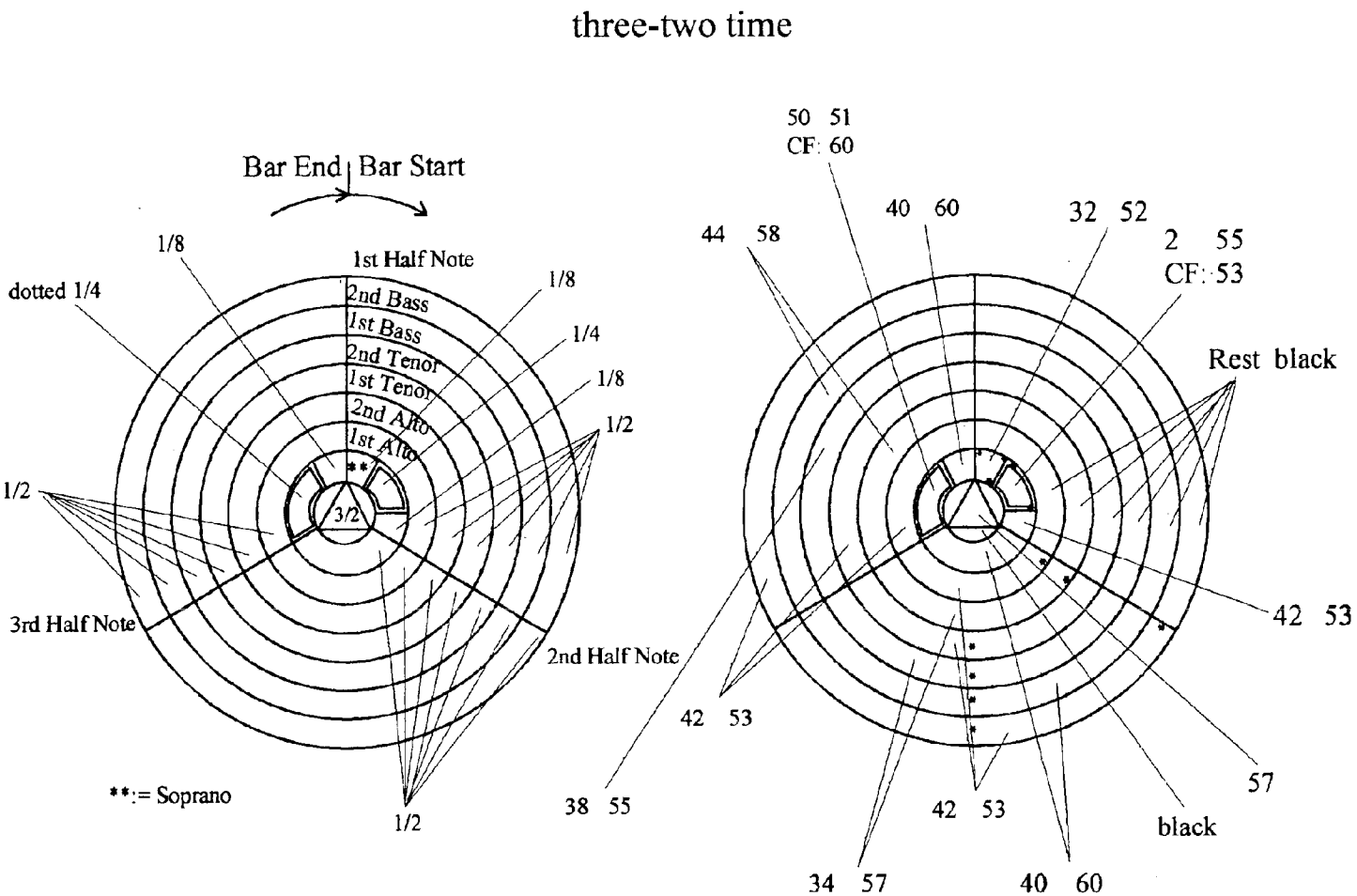
FIG. 29*c* The rosette-shaped color graphic of the $28^{th}$ bar (three-two time) according to FIG. 29*a* upon the reproduction of the species of time, the parts, and the note values.
FIG. 29*d* The rosette-shaped color graphic of the $28^{th}$ bar (three-two time) according to FIG. 29*a* upon the reproduction of the colors, the note signatures, and the pitches.
Figures 30C, 30D:
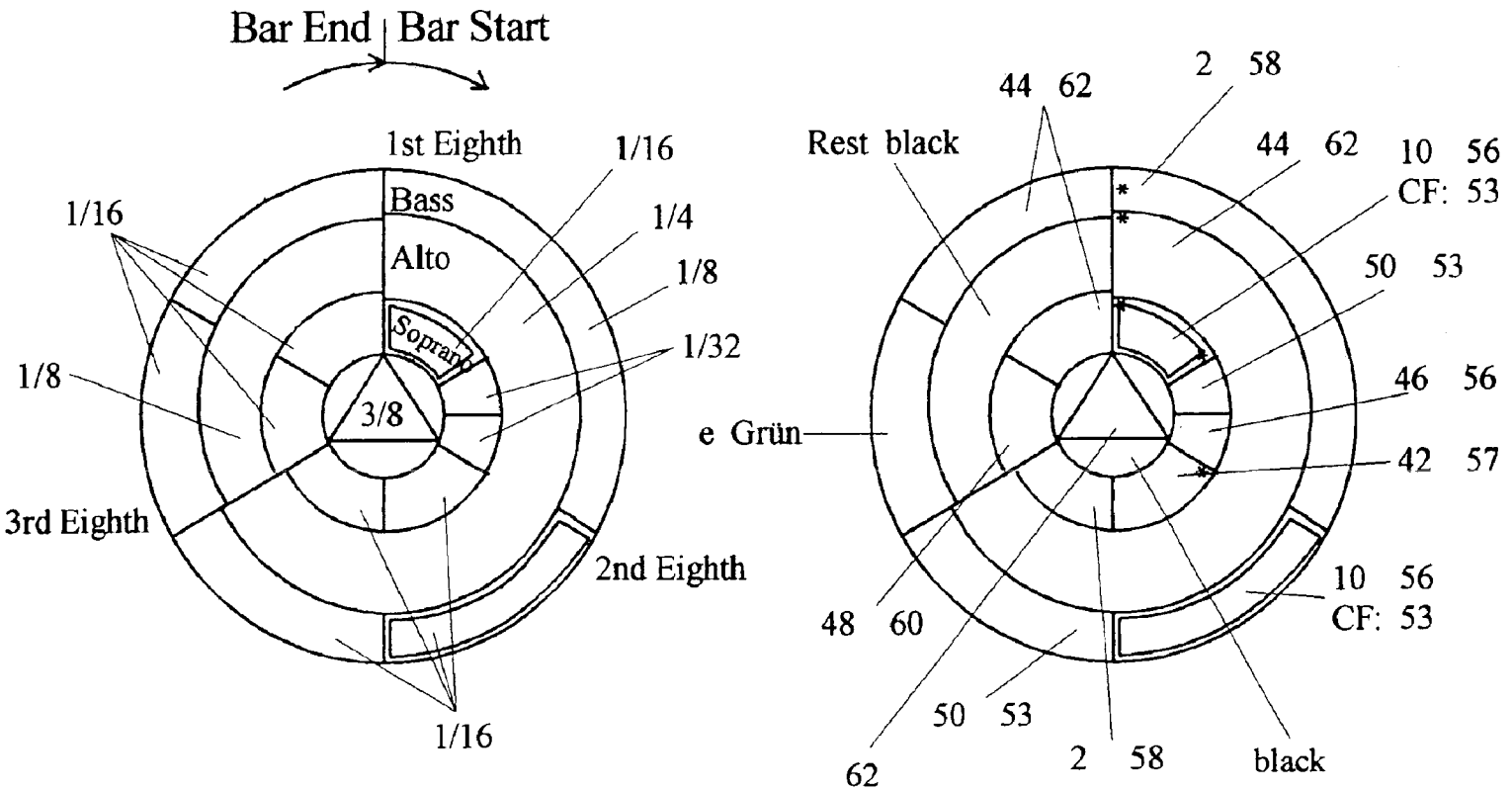
FIG. 30*c* The rosette-shaped color graphic of the $42^{nd}$ bar (three-eight time) according to FIG. 30*a* upon the reproduction of the species of time, the parts, and the note values.
FIG. 30*d* The rosette-shaped color graphic of the 42$^{nd}$ bar (three-eight time) according to FIG. 30*a* upon the reproduction of the colors, the note signatures, and the pitches.
Figures 31C, 31D:
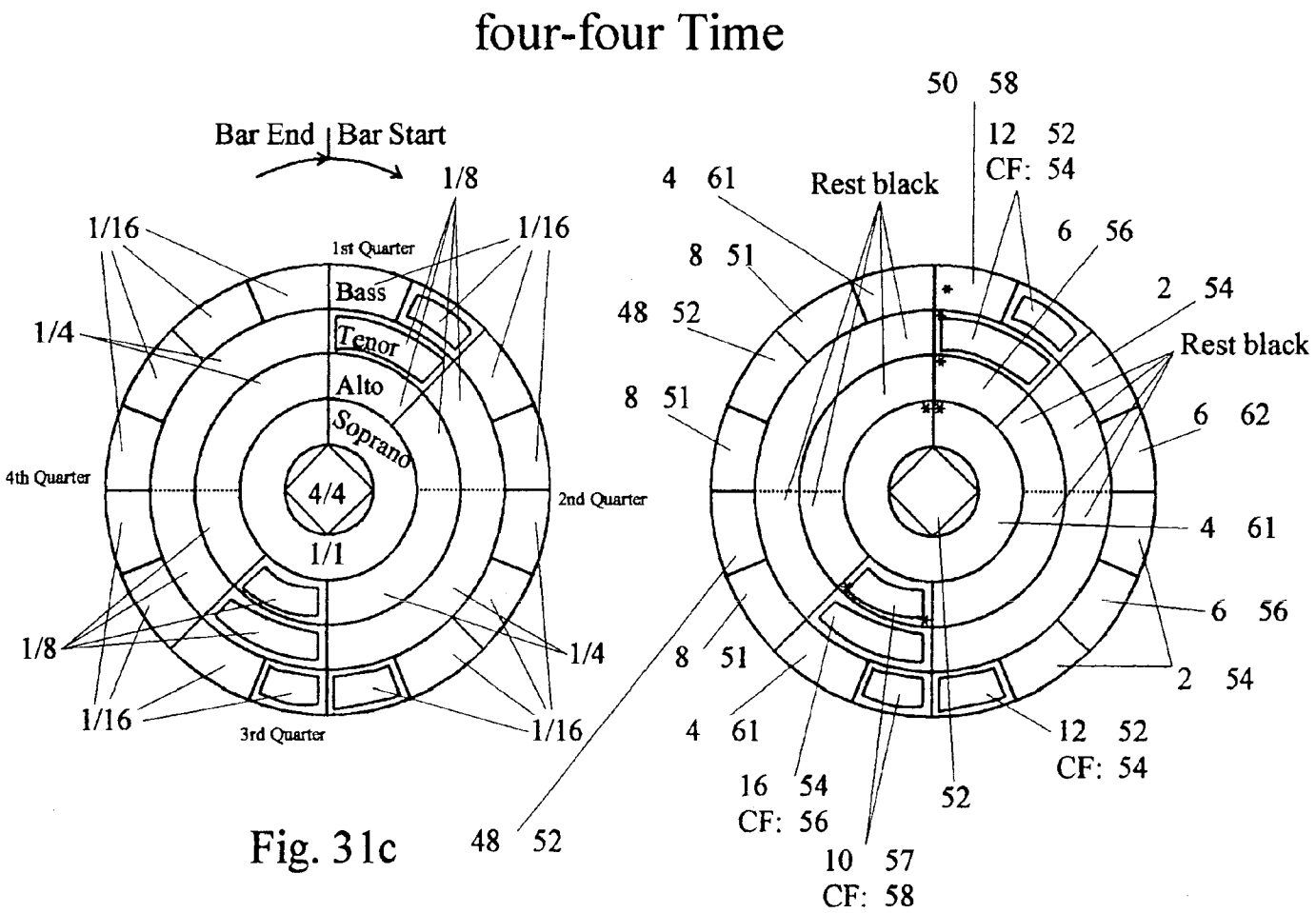
FIG. 31*c* The rosette-shaped color graphic of the 18$^{th}$ bar (four-four time) according to FIG. 31*a* upon the reproduction of the species of time, the parts, and the note values.
FIG. 31*d* The rosette-shaped color graphic of the 18$^{th}$ bar (four-four time) according to FIG. 31 *a* upon the reproduction of the colors, the note signatures, and the pitches.

As an example, FIGS. 29*a* to 29*d*, 30*a* to 30*d*, and 31*a* to 31*d* show the implementation of the procedure for the visually perceivable representation with regard to three musical bars from the "Well-Tempered Clavier, 1$^{st}$ Volume" by Johann Sebastian Bach, i.e. of the 28$^{th}$ bar of the Prelude No. VIII, in E flat minor 40, in three-two time and the 42$^{nd}$ bar of the Fugue XI, a 3 voci, F major 49, three-eight time and the 18$^{th}$ bar of the Prelude X, in E minor 4, four-four time, whereby the pitch level point system according to FIG. 26 has to be included in every case for the determination of the position of every tone in the FIGS. 29*d* and 30*d* and 31*d*.

With a design of the invention which uses the color circle of fifths according to FIG. 1*b*, the pre-determined, colored, two-dimensional area-element respectively the colored three-dimensional space-element assigned to every tone and/or meter of the music composition respectively the ring tone sequence is reproduced in the background of the display in the basic color of the color circle of fifths assigned to this tone and/or meter according to FIG. 1*b* in a color which is selected in accordance with the respective position of the tone and/or meter on the scale of the major or minor key of the music composition respectively the ring tone sequence from one of the above described 48 color key scales which consists of seven colors in each case in accordance with the scale which always consists of seven tones. The seven tones are displayed in each case as colored, square level elements, which are always evenly spaced with respect to one another, on the background of a color which is determined by the construction of the color circle of fifths for every respective major and parallel minor key pertaining to it. Here the colors of the major and minor color key scales refer always to only one major key with its parallel minor key pertaining to it. As regards the color key scales, the color of the first level of the respective major key always corresponds with the basic color of the respective major keys, while with regard to the respective parallel minor key the color of the third level always corresponds with the basic color of the respective minor color key scale.

Figure 32:
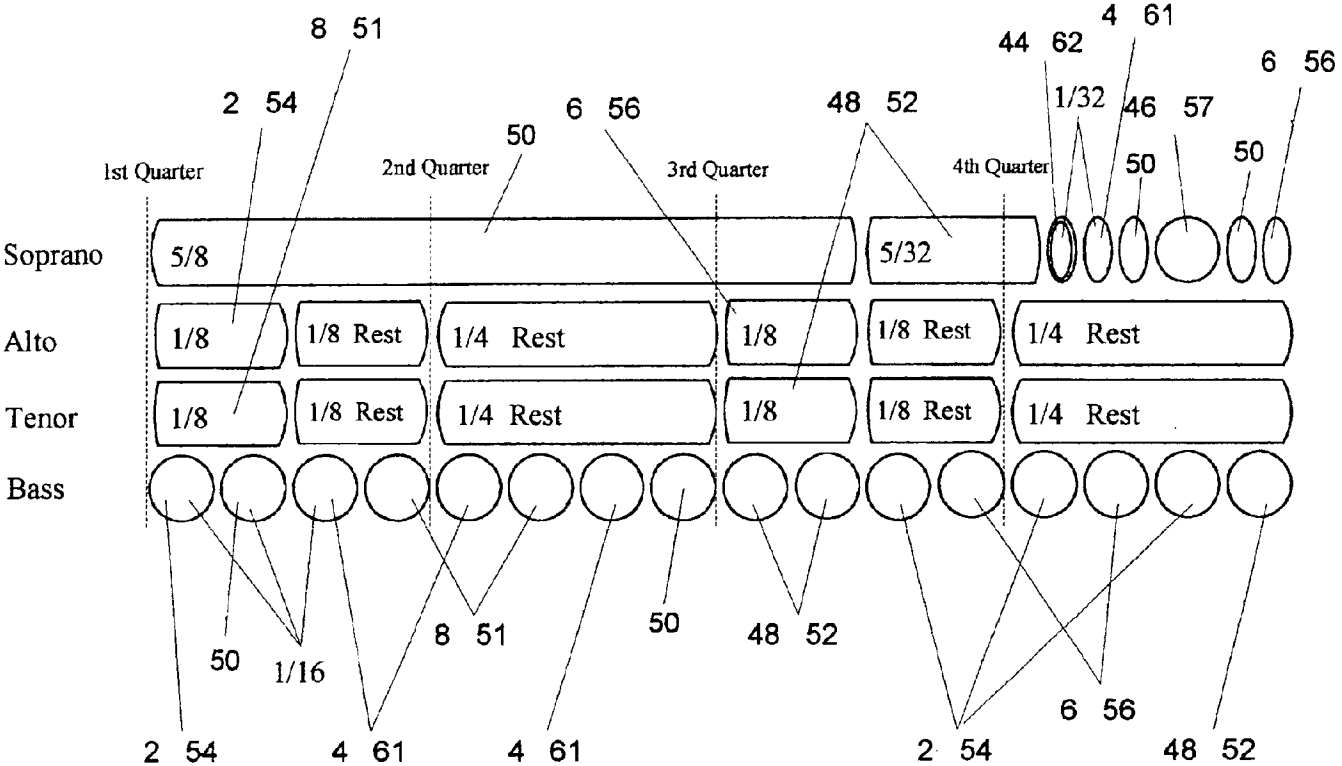
FIG. 32 A color graphic on a scale of 1:0.4 consisting of circular and ellipse-shaped as well as square-like 2D color elements of the 7$^{th}$ bar (four-four time) of the Prelude X, in E minor by Johann Sebastian Bach, with reproduction of the species of time, the voices, and the note values.
Figure 33:
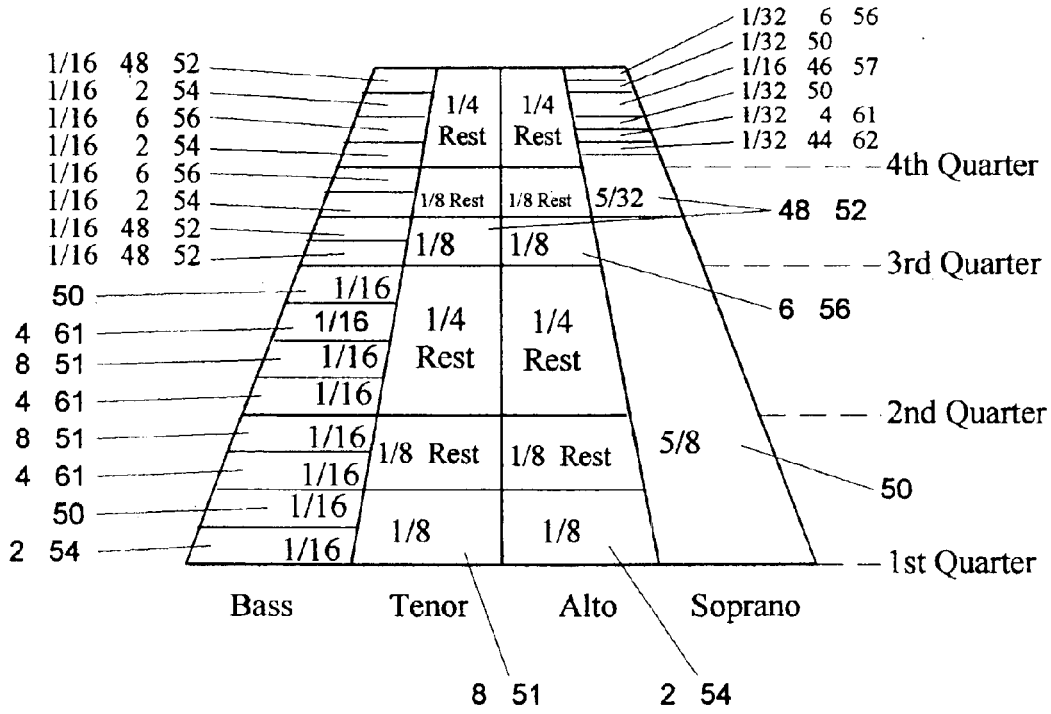
FIG. 33 A color which reproduces the 7$^{th}$ bar (four-four time) of the Prelude X, in E minor by Johann Sebastian Bach, in form of a four-lane street, running towards a vanishing point, on which 2D color elements which correspond with the musical bars move forward under reproduction of the species of time, the voices, and the note values.
Figure 34:
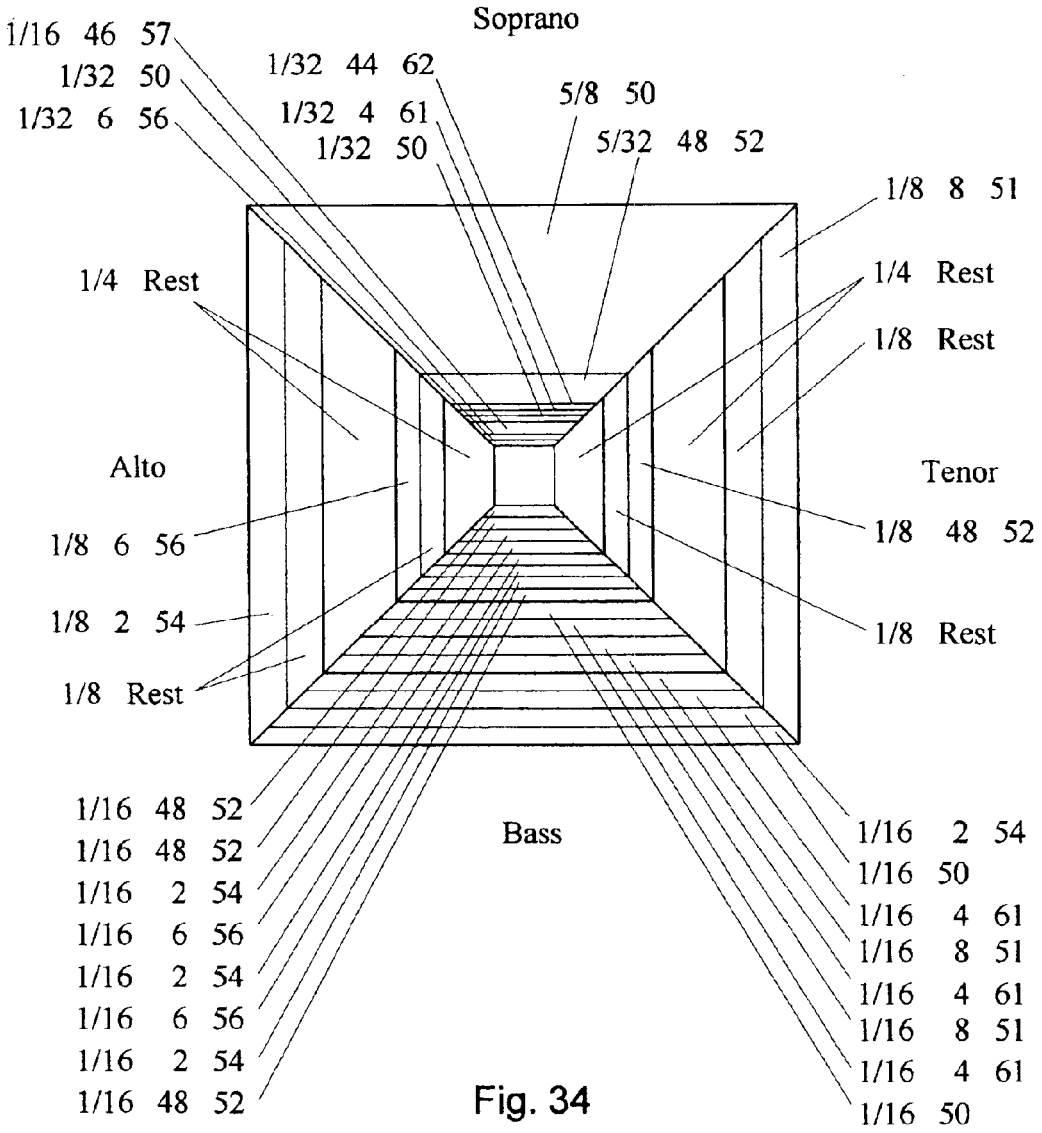
FIG. 34 A color graphic which reproduces the same time as under FIG. 32, however, in form of a tunnel which is square in profile and runs out towards the exit respectively runs in from the entry, from a square color element and a multitude of trapezoid color elements under reproduction of the species of time, the voices, and the note values.

As an example, FIGS. 32, 33, and 34 show the conversion of the method according to invention for the visually perceivable representation of the 7$^{th}$ bar of the Prelude X, four-four time, in E minor by Johann Sebastian Bach in color graphics composed of pre-determined 2D color elements, with the reproduction of the species of time, the voices soprano, alto, tenor, and bass, and the note values. According to FIG. 32 the color graphic consists of circular and ellipse-shaped as well as square-like 2D color elements. In FIG. 33 the 2D color elements which are pre-determined with regard to their outline profile and correspond with the musical bars, form a color graphic in form of a four-lane street running towards a vanishing point on which the 2D color elements move forwards. FIG. 34 shows a color graphic in form of a tunnel which is square in section, runs out towards the exit and in from the entry, of a square color element constituting the entry respectively the exit and a multitude of trapezoid color elements which are placed one next to the other. FIG. 36 shows a color graphic which is composed of square color elements whereby the completed meter produces a complete colored square and every voice (soprano, alto, tenor, bass) is reproduced by an own square. Such a structure of the color graphic can serve at the same time as a raster of a ring tone puzzle. The direction of reading of the color graphic according to FIG. 36 has, as graphically displayed in the latter at the left bottom, to take place in clockwise direction.

Figure 35:
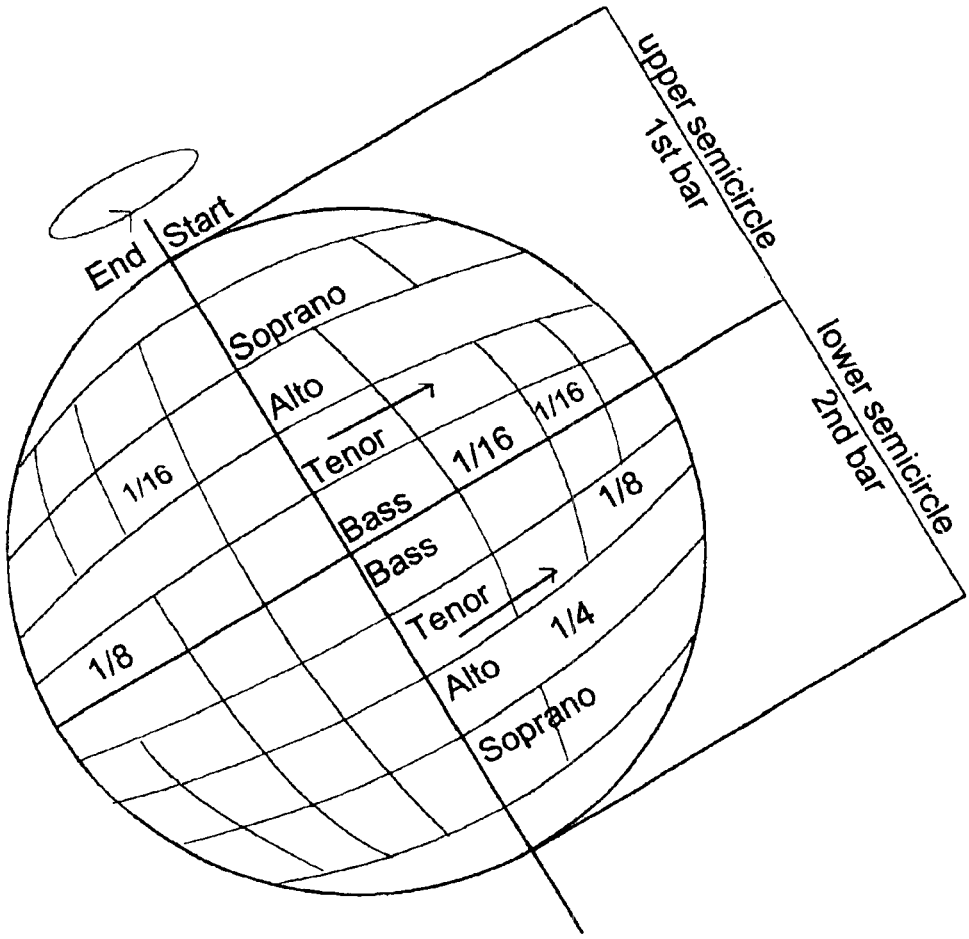
FIG. 35 A color graphic in form of a turning ball the surface of which is composed of 2D color elements whereby one time each is shown on both the upper and lower semi-circle.

FIG. 35 illustrates the program-controlled, visually perceivable representation of a music composition as a color graphic in form of a turning ball the surface of which is composed of 2D color elements whereby one meter each is shown on the upper as well as on the lower semi-circle.

Figure 37:
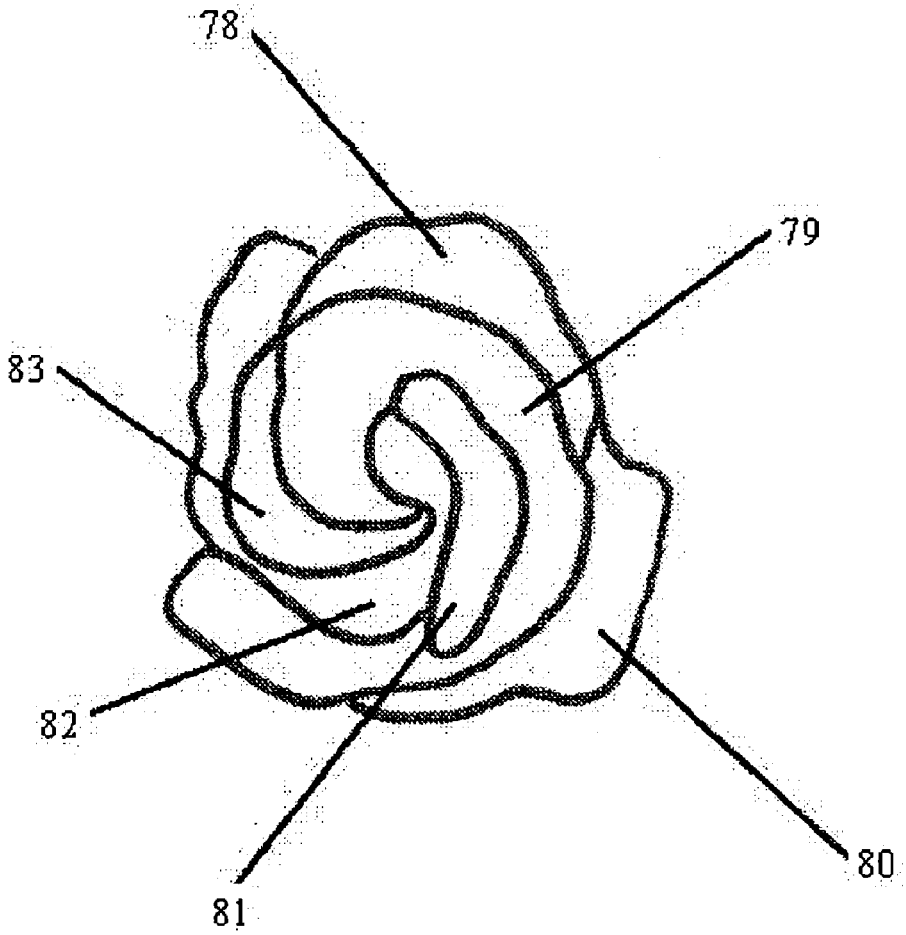
FIG. 37 The representation of a stylized rose in form of a puzzle which is composed of 2D color elements which are pre-determined with regard to their profile outline and position in accordance with an assigned ring tone sequence of a telephone, especially a cell phone.
Figure 38:
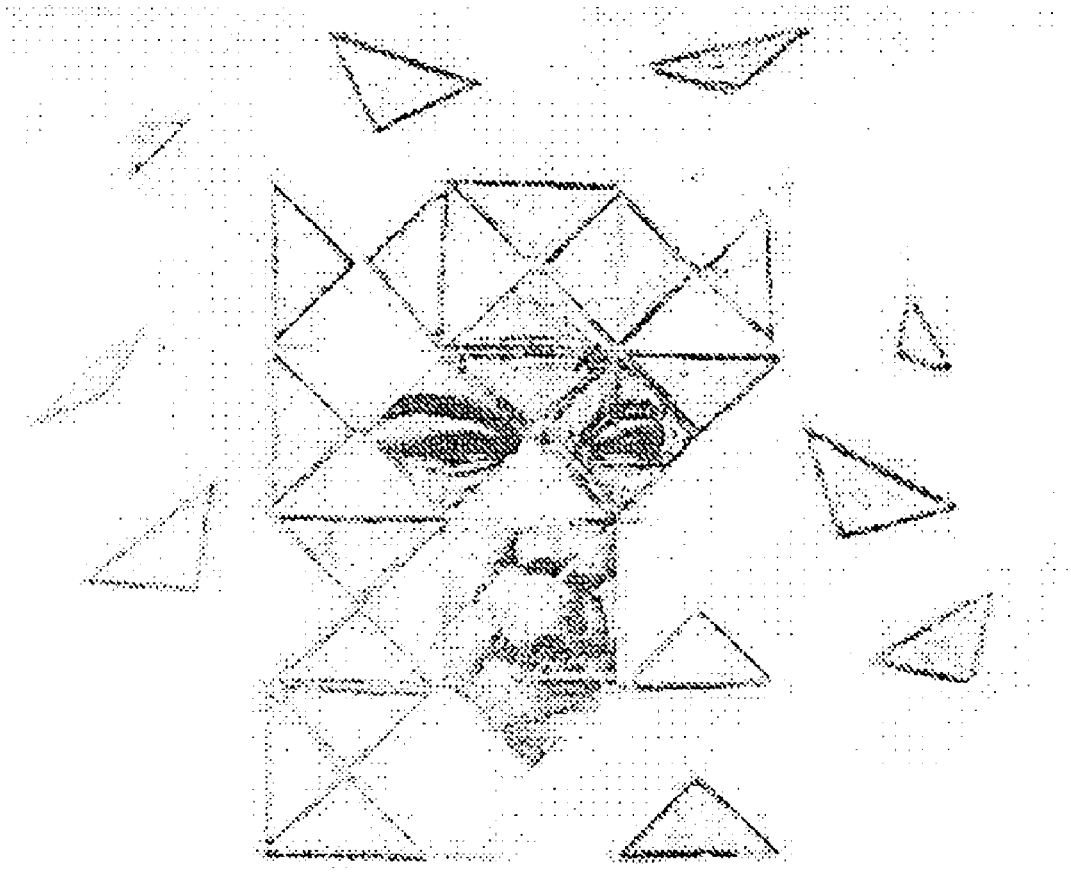
FIG. 38 A schematic representation of the raster image of a human face formed of 2D color elements which representation is composed in puzzle-shape according to a ring tone sequence.

FIGS. 37 and 38 illustrate the program controlled, visually perceivable puzzle-like representation of the ring tone sequence of, e.g., a cell phone. Thus FIG. 37 shows the representation of a stylized rose in form of a puzzle which is composed of 2D color elements 78–83 which are pre-determined with regard to their profile outline and position in accordance with an assigned ring tone sequence of the cell phone. Every leaf of the stylized rose corresponds with a tone or chord. FIG. 38 schematically illustrates a raster image of a human face forming in a puzzle-shape in accordance with a given ring tone sequence.

What is claimed is:

1. Method for the program-controlled visually perceivable representation of a music composition on the display of an electronic device, by means of control electronics with a processor integrated into the device, the method comprising the steps of:

reproducing the music composition in a program-controlled manner on the display of the electronic device by a multitude of two-dimensional or three-dimensional color elements which are equal to the number of tones and/or meters of the music composition and which are, in accordance with the tone and/or meter sequence of the music composition, chronologically configured on the display as follows:

forming the background of every color element on the display in a basic color which is assigned to the major or minor key of the music tone and/or music meter, which corresponds to the color element, in a color circle of fifths of the basic colors of all major and minor keys each of which has twenty-four colored circular segments of the same size, whereby in the color circle of fifths the keys are—starting from the circular segment lying in its zenith—relating to the twenty-four successive segments in clockwise direction, set as follows:

| | |
|---|---|
| C major and A minor | 1st segment |
| G major and E minor | 2nd segment |
| D major and B minor | 3rd segment |
| A major and F sharp minor | 4th segment |
| E major and C sharp minor | 5th segment |
| B major and G sharp minor | 6th segment |
| F sharp major and D sharp minor | 7th segment |
| C sharp major and A sharp minor | 8th segment |
| G sharp major and E sharp minor | 9th segment |
| D sharp major and B sharp minor | 10th segment |
| A sharp major and F double-sharp minor | 11th segment |
| E sharp major and C double-sharp minor | 12th segment |
| B sharp major and G double-sharp minor/ D double-flat major and BB minor | 13th segment |
| A double-flat major and F flat minor | 14th segment |
| E double-flat major and C flat minor | 15th segment |
| BB major and G flat minor | 16th segment |
| F flat major and D flat minor | 17th segment |
| C flat major and A flat minor | 18th segment |
| G flat major and E flat minor | 19th segment |
| D flat major and B minor | 20th segment |
| A flat major and F minor | 21st segment |
| E flat major and C minor | 22nd segment |
| B major and G minor | 23rd segment |
| F major and D minor | 24th segment |

whereby one of twelve basic colors, which are different from one another, of the color circle of fifths is assigned to each of the segments $1^{st}$ to $2^{th}$ and each of the segments $13^{th}$ to $24^{th}$, and whereby, for the color circle of fifths, the sequence of the twelve different basic colors assigned to the segments $1^{st}$ to $12^{th}$ and the sequence of the twelve different basic colors assigned to the segments $13^{th}$ to $24^{th}$ is the same and the sequence of the selected twelve basic colors within the twelve segments of every semi-circle can be varied, showing on the background of the display, the colored two-dimensional element or colored three-dimensional element assigned to every tone and/or meter of the music composition in the basic color of the color circle of fifths assigned to this tone and/or meter in a color which is selected according to the respective position of the tone and/or meter in the scale of the major or minor key of the music composition from one of the 48 color key scales, which consists, in accordance with the scale consisting of seven tones in each individual case, of always seven colors which are displayed as colored square level-elements, which are always evenly spaced with respect to one another, on the background of a color which is, by the construction of the color circle of fifths, determined for every respective major key and the parallel minor key pertaining to it, whereby the colors of the major and minor color key scales refer always to only one major key with the parallel minor key pertaining to it and where, with regard to the color key scales, the color of the first levels of the respective major key corresponds always to the basic color of the respective major keys, while with regard to the respective parallel minor key the color of the third level corresponds always to the basic color of the respective minor color-shade scale and whereby the seventh level of the respective color scale of the minor keys is always equipped with a frame-like designation the color of which is determined—in accordance with the designation of the sharpening of the seventh level in the harmonic minor scale by an accidental—in the tone sharpening by the color of the next higher level of the tone to be sharpened or with regard to the tone flattening by the color of the next lower level of the tone to be flattened, designating rests in the music composition in the colored two-dimensional element or the colored three-dimensional element by long black symbols;

reproducing the length of every tone and/or meter of the music composition in each case as a proportionally long circular segment respectively part of the colored two-dimensional element or the colored three-dimensional element, configured in the assigned color, and providing at least one symbol in every colored two-dimensional element or colored three-dimensional element, which is assigned to a tone and/or meter of the music composition which defines the octave within which the tone is positioned.

2. Method according to claim 1, wherein for the twelve different colors assigned to the segments $1^{st}$ to $12^{th}$ or the segments $13^{th}$ to $24^{th}$ of the color circle of fifths the colors green; yellow-green; yellow; orange-yellow; vermilion, purple; violet-red, violet; violet-blue; cobalt-blue, and turquoise are selected whereby the sequence of these colors changes for the color circle of fifths in the segments $1^{st}$ to $12^{th}$ or the segments $13^{th}$ to $24^{th}$.

3. Method according to claim 1, wherein the two-dimensional colored element assigned to every tone and/or meter of the music composition is configured as an ellipse, circle, triangle, square, rectangles, any polygon or part of these, line, dot, any two-dimensional contour-form, or part of a two-dimensional puzzle-image or photos.

4. Method according to claim 1, wherein the three-dimensional colored element assigned to every tone and/or meter of the music composition is configured as a cube, right parallelepiped, cylinder, bar, pyramid, globe, disk, beam, or part of these, or part of a 3-D-puzzle or body with any 3-D contour-form.

5. Method according to claim 1, wherein the three-dimensional elements assigned to the tones and/or meters of the music composition are represented, with the production of a disco-effect, random-generator-like, in a spatially distributed manner on the 3-D-image produced on the display.

6. Method for the program-controlled visually perceivable representation of a music composition on the display of an electronic device by means of control electronics, integrated into the latter, and equipped with a processor, whereby, if required, the music composition is simultaneously reproduced acoustically in an electronic manner, the method comprising the steps of:

reproducing the music composition in a program-controlled manner on the display of the electronic device by a multitude of color graphics which is equal to the number of musical bars of the music composition and which are, in accordance with the bar sequence of the music composition, arranged in succession in each case alone on the display as follows:

forming the background of every color graphic on the display in a basic color which is assigned to the major or minor key of the musical bar which corresponds to the color graphic in a color circle of fifths of the basic colors of all major and minor keys that has twenty-four coloured circular segments lying in its zenith in clockwise direction, the colour graphic assigned to every musical bar of the music composition being shown on the background of the display in the basic color of the color circle of fifths assigned to this musical bar in the form of a circular rosette whereby the musical bar is displayed as at least one circular ring of the rosette which is—seen in the circumferential direction—in accordance with the species of time divided into parts of the same circular arc;

showing the tones of the musical bar in the rosette-shaped color graphic in a color which is chosen in accordance with the respective position of every tone in the scale of the major or minor key of the musical bar from one of the 48 color key scales listed below, which consists, in accordance with the scale consisting of seven tones in each individual case, of seven colors in each individual case, which are displayed in each individual case as respectively colored square level-elements evenly spaced on the background of one color which is determined by the construction of the color circle of fifths for every respective major and minor key pertaining to it and whereby the colors of the major and minor color key scales refer always to only one major key with the parallel minor key pertaining to it and with regard to the color key scales the color of the first levels of the respective major key corresponds always to the basic color of the respective major key, while with regard to the respective parallel minor key the color of the third level corresponds always to the basic color of the respective minor color key scale and whereby always the seventh level of the respective color scale of the minor keys is equipped with a frame-like designation the color of which is determined—in accordance with the designation of the sharpening of the seventh level in the harmonic minor scale by an accidental—in the tone sharpening by the color of the next higher level of the tone to be sharpened or with regard to the tone flattening by the color of the next lower level of the tone to be flattened so that the following applies:

2*a*) C major (1)=green (51)

Tones: C (1)=green (51); D (5)=yellow (53); E (9)=orange-red (55); F (49)=vermilion (56); G (3)=purple (57); A (7)=violet-blue (60); B (11)=turquoise (62)

2*b*) A minor (2)=green (51)

Tones: A (2)=violet-blue (60); B (6)=turquoise (62); C (46)=green (51); D (50)=yellow (53); E (4)=orange-red (55); F (44)=vermilion (56); G sharp (12)=purple (57) frame-like designation of the $7^{th}$ level=violet-blue (60)

3*a*) G major (3)=yellow-green (52)

Tones: G (3)=yellow-green (52); A (7)=orange-red (55); B (11)=vermilion (56); C (1)=purple (57); D (5)=violet-red (58); E (9)=cobalt-blue (61); F sharp (13)=green (51)

3*b*) E minor (4)=yellow-green (52)

Tones: E (4)=cobalt-blue (61); F sharp (8)=green (51); G (48)=yellow-green (52); A (2)=orange-yellow (54); B (6)=vermilion (56); C (46)=purple (57); D sharp (14)=violet-red (58), frame-like designation of the $7^{th}$ level=cobalt-blue (61)

4*a*) D major (5)=yellow (53)

Tones: D (5)=yellow (53); E (9)=orange-red (55); F sharp (13)=purple (57); G (3)=violet-red (58); A (7)=violet (59); B (11)=turquoise (62); C sharp (15)=yellow-green (52)

4*b*) B minor (6)=yellow (53)

Tones: B (6)=turquoise (62); C sharp (10)=yellow-green (52); D (50)=yellow (53); E (4)=orange-red (55); F sharp (8)=purple (57); G (48)=violet-red (58); A sharp (16)=violet (59) frame-like designation of the $7^{th}$ level=turquoise (62)

5*a*) A major (7)=orange-yellow (54)

Tones: A (7)=orange-yellow (54); B (11)=vermilion (56); C sharp (15)=violet-red (58); D (5)=violet (59); E (9)=violet-blue (60); F sharp (13)=green (51); G sharp (17)=yellow (53)

5*b*) F sharp minor (8)=orange-yellow (54)

Tones: F sharp (8)=green (51); G sharp (12)=yellow (53); A (2)=orange-yellow (54); B (6)=vermilion (56); C sharp (10)=violet-red (58); D (50)=violet (59); E sharp (18)=violet-blue (60) frame-like designation of the $7^{th}$ level green (51)

6*a*) E major (9)=orange-red (55)

Tones: E (9)=orange-red (55); F sharp (13)=purple (57); G sharp (17)=violet (59); A (7)=violet-blue (60); B (11)=cobalt-blue (61); C sharp (15)=yellow-green (52); D sharp (19)=orange-yellow (54)

6*b*) C sharp minor (10)=orange-red (55)

Tones: C sharp (10)=yellow-green (52); D sharp (14)=orange-yellow (54); E (4)=orange-red (55); F sharp (8)=purple (57); G sharp (12)=violet (59); A (2)=violet-blue (60); B sharp (20)=cobalt-blue (61), frame-like designation of the $7^{th}$ level=yellow-green (52)

7*a*) B major (11)=vermilion (56)

Tones: B (11)=vermilion (56); C sharp (15)=violet-red (58); D sharp (19)=violet-blue (60); E (9)=cobalt-blue (61); F sharp (13)=turquoise (62); G sharp (17)=yellow (53); A sharp (21)=orange-red (55)

7*b*) G sharp minor (12)=vermilion (56)

Tones: G sharp (12)=yellow (53); A sharp (16)=orange-red (55); B (6)=vermilion 6); C sharp (10)=violet-red (58); D sharp (14)=violet-blue (60); E (4)=cobalt-blue (61); F double-sharp (22)=turquoise (62) frame-like designation of the $7^{th}$ level=yellow (53)

8*a*) F sharp major (13)=purple (57)

Tones: F sharp (13)=purple (57); G sharp (17)=violet (59); A sharp (21)=cobalt-blue (61); B (11)=turquoise (62); C sharp (15)=green (51); D sharp (19)=orange-yellow (54); E sharp (23)=vermilion (56)

8*b*) D sharp minor (14)=purple (57)

Tones: D sharp (14)=orange-yellow (54); E sharp (18)=vermilion (56); F sharp (8)=purple (57); G sharp (12)=violet (59); A sharp (16)=cobalt-blue (61); B (6)=turquoise (62); C double-sharp (24)=green (51), frame-like designation of the $7^{th}$ level=orange-yellow (54)

9*a*) C sharp major (15)=violet-red (58)

Tones: C sharp (15)=violet-red (58); D sharp (19)=violet-blue (60); E sharp (23)=turquoise (62); F sharp (13)=green (51); G sharp (17)=yellow-green (52); A sharp (21)=orange-red (55); B sharp (27)=purple (57)

9*b*) A sharp minor (16)=violet-red (58)

Tones: A sharp (16)=orange-red (55); B sharp (20)=purple (57); C sharp (10)=violet-red (58); D sharp (14)=violet-blue (60); E sharp (18)=turquoise (62); F sharp (8)=green (51); G double-sharp (28)=yellow-green (52), frame-like designation of the $7^{th}$ level=orange-red (55)

10*a*) G sharp major (17)=violet (59)

Tones: G sharp (17)=violet (59); A sharp (21)=cobalt-blue (61); B sharp (27)=green (51); C sharp (15)=yellow-green (52); D sharp (19)=yellow (53); E sharp (23)=vermilion (56); F double-sharp (63)=violet-red (58)

10*b*) E sharp minor (18)=violet (59)

Tones: E sharp (18)=vermilion (56); F double sharp (22)=violet-red (58); G sharp (12)=violet (59); A sharp (16)=cobalt-blue (61); B sharp (20)=green (51); C sharp (10)=yellow-green (52); D double-Sharp (64)=yellow (53), frame-like designation of the $7^{th}$ level=vermilion (56)

11*a*) D sharp major (19)=violet-blue (60)

Tones: D sharp (19)=violet-blue (60); E sharp (23)=turquoise (62); F double-sharp (63)=yellow-green (52); D sharp (17)=yellow (53); A sharp (21)=orange-yellow (54); B sharp (27)=purple (57); C double-sharp (65)=violet (59)

11*b*) B sharp minor (20)=violet-blue (60)

Tones: B sharp (20)=purple (57); C double-sharp (24)=violet (59); D sharp (14)=violet-blue (60); E sharp (18)=turquoise (62); F double-sharp (22)=yellow-green (52); G sharp (12)=yellow (53); A double-sharp (66)=orange-yellow (54), frame-like designation of the $7^{th}$ level=purple (57)

12*a*) A sharp major (21)=cobalt-blue (61)

Tones: A sharp (21)=cobalt-blue (61); B sharp (27)=green (51); C double-sharp (65)=yellow (53); D sharp (19)=orange-yellow (54); E sharp (23)=orange-red (55); F double-sharp (63)=violet-red (58); G double-sharp (67)=violet-blue (60)

12*b*) F double-sharp minor (22)=cobalt-blue (61)

Tones: F double-sharp (22)=violet-red (58); G double-sharp (28)=violet-blue (60); A sharp (16)=cobalt-blue (61); B sharp (20)=green (51); C double-sharp (24)=yellow (53); D sharp (14)=orange-yellow (54); E double-sharp (68)=orange-red (55), frame-like designation of the $7^{th}$ level=violet-red (58)

13*a*) E sharp major (23)=turquoise (62)

Tones: E sharp (23)=turquoise (62); F double-sharp (63)=yellow-green (52); G double-sharp (67)=orange-yellow (54); A sharp (21)=orange-red (55); B sharp (27)=vermilion (56); C double-sharp (65)=violet (59); D double-sharp (69)=cobalt-blue (61)

13*b*) C double-sharp minor (24)=turquoise (62)

Tones: C double-sharp (24)=violet (59); D double-sharp (64)=cobalt-blue (61); E sharp (18)=turquoise (62); F double-sharp (22)=yellow-green (52); G double-sharp (28)=orange-yellow (54); A sharp (16)=orange-red (55); B double-sharp (70)=vermilion (56), frame-like designation of the $7^{th}$ level violet (59)

14*a*) F major (49)=turquoise (62)

Tones: F (49)=turquoise (62); G (3)=violet-blue (60); A (7)=violet-red (58); B flat (47)=purple (57); C (1)=vermilion (56); D (5)=yellow (53); E (9)=green (51)

14*b*) D minor (50)=turquoise (62)

Tones: D (50)=yellow (53); E (4)=green (51); F (44)=turquoise (62); G (48)=violet-blue (60); A (2)=violet-red 58); B flat (42)=purple (57); C sharp (10)=vermilion (56), frame-like designation of the $7^{th}$ level=yellow (53)

15*a*) B flat major (47)=cobalt-blue (61)

Tones: B flat (47)=cobalt-blue (61); C (1)=violet (59); D (5)=purple (57); E flat (45)=vermilion (56); F (49)=orange-red (55); G (3)=yellow-green (52); A (7)=turquoise (62)

15*b*) G minor (48)=cobalt-blue (61)

Tones: G (48)=yellow-green (52); A (2)=turquoise (62); B flat (42)=cobalt-blue (61); C (46)=violet (59); D (50)=purple (57); E flat (40)=vermilion (56); F sharp (8)=orange-red (55), frame-like designation of the $7^{th}$ level=yellow-green (52)

16*a*) E flat major (45)=violet-blue (60)

Tones: E flat (45)=violet-blue (60); F (49)=violet-red (58); G (3)=vermilion (56); A flat (43)=orange-red (55); B flat (47)=orange-yellow (54); C (1)=green (51); D (5)=cobalt-blue (61)

16*b*) C minor (46)=violet-blue (60)

Tones: C (46)=green (51); D (50)=cobalt-blue (61); E flat (40)=violet-blue (60); F (44)=violet-red (58); G (48)=vermilion (56); A flat (38)=orange-red (55); B (6)=orange-yellow (54), frame-like designation of the $7^{th}$ level=green (51)

17*a*) A flat major (43)=violet (59)

Tones: A flat (43)=violet (59); B flat (47)=purple (57); C (1)=orange-red (55); D flat (41)=orange-yellow (54); E flat (45)=yellow (53); F (49)=turquoise (62); G (3)=violet-blue (60)

17*b*) F minor (44)=violet (59)

Tones: F (44)=turquoise (62); G (48)=violet-blue (60); A flat (38)=violet (59); B flat (42)=purple (57); C (46)=orange-red (55); D flat (36)=orange-yellow (54); E (4)=yellow (53), frame-like designation of the $7^{th}$ level=turquoise (62)

18*a*) D flat major (41)=violet-red (58)

Tones: D flat (41)=violet-red; E flat (45)=vermilion (56); F (49)=orange-yellow (54); G flat (39)=yellow (53); A flat (43)=yellow-green (52); B flat (47)=cobalt-blue (61); C (1)=violet (59)

18*b*) B flat minor (42)=violet-red (58)

Tones: B flat (42)=cobalt-blue (61); C (46)=violet (59); D flat (36)=violet-red (58); E flat (40)=vermilion (56); F (44)=orange-yellow (54); G flat (34)=yellow (53); A (2)=yellow-green (52), frame-like designation of the $7^{th}$ level=cobalt-blue

19*a*) G flat major (39)=purple (57)

Tones: G flat (39)=purple (57); A flat (43)=orange-red (55); B flat (47)=yellow (53); C flat (37)=yellow-green (52); D flat (37)=green; E flat (45)=violet-blue (60); F (49)=violet-red (58)

19*b*) E flat minor (40)=purple (57)

Tones: E flat (40)=violet-blue (60); F (44)=violet-red (58); G flat (34)=purple (57); A flat (38)=orange-red (55); B flat (42)=yellow (53); C flat (32)=yellow-green (52); D (50)=green (51), frame-like designation of the $7^{th}$ level=violet-blue (60)

20*a*) C flat major (37)=vermilion (56)

Tones: C flat (37)=vermilion (56); D flat (41)=orange-yellow (54); E flat (45)=yellow-green (52); F flat (35)=green (51); G flat (39)=turquoise (62); A flat (43)=violet (59); B flat (47)=purple (57)

20*b*) A flat minor (38)=vermilion (56)

Tones: A flat (38)=violet (59); B flat (42)=purple (57); C flat (32)=vermilion (56); D flat (36)=orange-yellow (54); E flat (40)=yellow-green (52); F flat (30)=green (51); G (48)=turquoise (62), frame-like designation of the $7^{th}$ level=violet (59)

21*a*) F flat major (35)=orange-red (55)

Tones: F flat (35)=orange-red (55); G flat (39)=yellow (53); A flat (43)=green (51); B double-flat (33)= turquoise (62); C flat (37)=cobalt-blue (61); D flat (41)=violet-red (58); E flat (45)=vermilion (56)

21*b*) D flat minor (36)=orange-red (55)

Tones: D flat (36)=violet-red (58); E flat (40)=vermilion (56); F flat (30)=orange-red (55); G flat (34)=yellow (53); A flat (38)=green (51); B double-flat (26)=turquoise (62); C (46)=cobalt-blue (61), frame-like designation of the $7^{th}$ level=violet-red (58)

22*a*) B double-flat major (33)=orange-yellow (54)

Tones: B double-flat (33)=orange-yellow (54); C flat (37)=yellow-green (52); D flat (41)=turquoise (62); E double-hat (31)=cobalt-blue (61); F flat (35)=violet-blue (60); G flat (39)=purple (57); A flat (43)=orange-red (55)

22*b*) G flat minor (34)=orange-yellow (54)

Tones: G flat (34)=purple (57); A flat (38)=orange-red (55); B double-flat (26)=orange-yellow (54); C flat (32)=yellow-green (52); D flat (36)=turquoise (62); E double-flat (71)=cobalt-blue (61); F (44)=violet-blue (60), frame-like designation of the $7^{th}$ level=purple (57)

23*a*) E double-flat major (31)=yellow (53)

Tones: E double-flat (31)=yellow (53); F flat (35)=green (51); G flat (39)=cobalt-blue (61); A double-flat (29)=violet-blue (60); B double-flat (33)=violet (59); C flat (37)=vermilion (56); D flat (41)=orange-yellow (54)

23*b*) C flat minor (32)=yellow (53)

Tones: C flat (32)=vermilion (56); D flat (36)=orange-yellow (54); E double-flat (71)=yellow (53); F flat (30)=green (51); G flat (34)=cobalt-blue (61); A double-flat (72)=violet-blue (60); B flat (42)=violet (59), frame-like designation of the $7^{th}$ level=vermilion (56)

24*a*) A double-flat major (29)=yellow-green (52)

Tones: A double-flat (29)=yellow-green (52); B double-flat (33)=turquoise (62); C flat (37)=violet-blue (60); D double-flat (25)=violet (59); E double-flat (31)=violet-red (58); F flat (35)=orange-red (55); G flat (39)=yellow (53)

24*b*) F flat minor (30)=yellow-green (52)

Tones: F flat (30)=orange-red (55); G flat (34)=yellow (53); A double-flat (72)=yellow-green (52); B double-flat (26)=turquoise (62); C flat (32)=violet-blue (60); D double-flat (73)=violet (59); E flat (40)=violet-red (55), frame-like designation of the $7^{th}$ level=orange-red (55)

25*a*) D double-flat major (25) identical to B sharp major (27)=green (51)

Tones: D double-flat (25) (B sharp (27))=green (51); E double-flat (31) (C double-sharp (65)=cobalt-blue (61); F flat (35) (D double-sharp (69)=violet (59); G double-flat (76) (E sharp (23))=violet-red (58); A double-flat (29) (F double-sharp (63)=purple (57); B double-flat (33) (G double-sharp) (67))=orange-yellow (54); C flat (37) (A double-sharp 75)=yellow-green (52)

25*b*) B double-flat minor (26) identical to G double-sharp minor (28)=green (51)

Tones: B double-flat (26) (G double-sharp (28))=orange-yellow (54); C flat (32) (A double-sharp (66))=yellow-green (52); D double-flat (73) (B sharp (20))=green (51); E double-flat (71) (C double-sharp (24))=cobalt-blue (61); F flat (30) (D double-sharp (64))=violet (59); G double-flat (77) (E sharp (18))=violet-red (58); A flat (38) (F triple-sharp (74))=purple (57), frame-like designation of the $7^{th}$ level=orange-yellow (54)

identifying rests in the musical bar of the rosette-shaped color graphic in black in the at least one circular ring;

reproducing the length of every tone and/or every rest of a musical bar is in each case as a proportionally long circular segment, arranged in the assigned color, of the at least one circular ring of the rosette-shaped color graphic, and providing at least one symbol in every color field of the circular ring which is assigned to a tone in the musical bar, which defines the octave within which the tone is positioned.

7. Method according to claim 1, wherein the music composition is simultaneously reproduced acoustically in an electronic manner.

8. Method according to claim 6, wherein the rosette-shaped color graphic of every musical bar of the music composition is arranged with a multitude of concentric circular rings which corresponds to the number of parts of the latter whereby the pitch of the individual parts is assigned to the concentric circular rings in such a manner that, beginning from the innermost circular ring to the outermost circular ring, the part descends from the in each case highest register to the in each case lowest register of the musical bar.

9. Method according to claim 6, wherein a graphic symbol which makes the species of time of the relevant musical bar stand out optically in each case is provided in the centre of the rosette-shaped color graphic.

10. Method according to claim 6, wherein a mobile phone is chosen as the electronic device.

11. Method according to claim 6, wherein an electronic watch is chosen as the electronic device the face of which is used as display for the program-controlled, visually perceivable representation of always one rosette-shaped color graphic in accordance with the musical bar of the music composition that is assigned in each individual case.

12. Method according to claim 11, wherein the control of the visually perceivable representation of the individual musical bars of the musical composition are such that the representation of the respective rosette-shaped color graphics on the display of the electronic watch changes from one minute to next or from hour to hour in accordance with the sequence of the musical bars of the music composition.

13. Method according to claim 1, wherein the two-dimensional and/or three-dimensional color elements of color images, color photos, or any predetermined 2D-profile outlines respectively a rosette-shaped color graphic respectively a colored body or any colored predetermined 3D-contours generated on the display of the electronic device, are electronically recorded and converted, on the basis of their basic color, into acoustically perceivable tones, chords, and/or tone and meter sequences of the music composition, in a program-controlled manner in accordance with the respective assignment of the two- and/or three-dimensional color elements to the in each case corresponding segments under the segments $1^{st}$ to $12^{th}$ or $13^{th}$ to $24^{th}$ of the color circle of fifths as well as in accordance with the assigned color key scale of the set 48 color key scales and in accordance with the keys assigned to the segments respectively the colors of the color circle of fifths in a programmed-controlled manner.

14. Method according to claim 13, including providing an electronic color paint box for composing a music composition with the use of the given color circle of fifths, color key scales and tones, chords, and/or musical bars as well as major and/or minor keys assigned to them accordingly.

15. Method according to claim 6, wherein the two-dimensional and/or three-dimensional color elements of color images, color photos, or any predetermined 2D-profile outlines respectively a rosette-shaped color graphic respectively a colored body or any colored predetermined 3D-contours generated on the display of the electronic device, are electronically recorded and converted, on the basis of their basic color, into acoustically perceivable tones, chords, and/or tone and meter sequences of the music composition, in a program-controlled manner in accordance with the respective assignment of the two- and/or three-dimensional color elements to the in each case corresponding segments under the segments $1^{st}$ to $12^{th}$ or $13^{th}$ to $24^{th}$ of the color circle of fifths as well as in accordance with the assigned color key scale of the set 48 color key scales and in accordance with the keys assigned to the segments respectively the colors of the color circle of fifths in a programmed-controlled manner.

16. Method according to claim 15, including providing an electronic color paint box for composing a music composition with the use of the given color circle of fifths, color key scales and tones, chords, and/or musical bars as well as major and/or minor keys assigned to them accordingly.

17. Method according to claim 6, wherein the music composition is simultaneously reproduced acoustically in an electronic manner.

* * * * *